US011325019B2

(12) United States Patent
Heim et al.

(10) Patent No.: US 11,325,019 B2
(45) Date of Patent: May 10, 2022

(54) POLE HANDLE AND POLE COMPRISING SAID POLE HANDLE

(71) Applicant: LEKISPORT AG, Baar (CH)

(72) Inventors: Eberhard Heim, Unterensingen (DE); Tobias Böing, Grossbettlingen (DE); Jan Vocelka, Tachov (CZ)

(73) Assignee: LEKISPORT AG, Baar (CH)

( * ) Notice: Subject to any disclaimer, the term of this patent is extended or adjusted under 35 U.S.C. 154(b) by 29 days.

(21) Appl. No.: 17/051,203

(22) PCT Filed: Apr. 23, 2019

(86) PCT No.: PCT/EP2019/060341
§ 371 (c)(1),
(2) Date: Oct. 28, 2020

(87) PCT Pub. No.: WO2019/211124
PCT Pub. Date: Nov. 7, 2019

(65) Prior Publication Data

US 2021/0228972 A1 Jul. 29, 2021

(30) Foreign Application Priority Data

May 4, 2018 (CH) ..... 00563/18

(51) Int. Cl.
*A63C 11/22* (2006.01)
*A45B 9/02* (2006.01)

(52) U.S. Cl.
CPC ..... *A63C 11/2224* (2020.08); *A45B 9/02* (2013.01); *A63C 11/227* (2013.01); *A63C 11/2228* (2020.08); *A45B 2009/025* (2013.01)

(58) Field of Classification Search
CPC ..... A45B 2009/025; A63C 11/222; A63C 11/2224; A63C 11/2227; A63C 11/2228
See application file for complete search history.

(56) References Cited

U.S. PATENT DOCUMENTS 5,110,154 A 5/1992 Street
5,516,150 A 5/1996 Goode et al.
(Continued)

FOREIGN PATENT DOCUMENTS

EP 1 970 105 A1 9/2008
EP 2 046 158 A1 4/2009
(Continued)

OTHER PUBLICATIONS

International Search Report of PCT/EP2019/060341 dated Sep. 27, 2019 [PCT/ISA/210].

*Primary Examiner* — Brian L Swenson
(74) *Attorney, Agent, or Firm* — Sughrue Mion, PLLC

(57) ABSTRACT

Pole handle, for alpine ski poles or cross-country ski poles, with a handle body and with a hook for fastening a hand holding device. A displaceable latching structure is arranged in the region of the hook so that an eye-shaped device which is pushed in from above and is provided on the hand holding device is fixed in a self-locking manner. The hook is arranged on the stick handle on the hand side in the upper region. A holding mandrel, which is set off from the handle body to the hand side, forms an insertion slot. The latching structure includes a retaining lug which defines a region, restricted against a force, for the eye-shaped device. An upper region of the holding mandrel or the entire holding mandrel, viewed in the running direction, can be deflected laterally on both sides against a restoring force.

38 Claims, 16 Drawing Sheets

(56) References Cited

U.S. PATENT DOCUMENTS

| | | | | |
|---|---|---|---|---|
| 2005/0005404 | A1* | 1/2005 | Panizza | A63C 11/2224 16/436 |
| 2006/0143867 | A1* | 7/2006 | Wu | A63C 11/2224 16/436 |
| 2008/0169635 | A1* | 7/2008 | Panizza | A63C 11/2224 280/822 |
| 2010/0218347 | A1* | 9/2010 | Lenhart | A63C 11/2224 16/421 |
| 2013/0140803 | A1 | 6/2013 | Roiser | |
| 2015/0165305 | A1* | 6/2015 | Donnadieu | A45B 9/02 280/821 |
| 2016/0136507 | A1* | 5/2016 | Bennert | A63C 11/2228 280/822 |
| 2017/0231339 | A1* | 8/2017 | Kreis | A63C 11/2224 135/76 |
| 2018/0271236 | A1* | 9/2018 | Heim | A45B 9/02 |

FOREIGN PATENT DOCUMENTS

| | | | |
|---|---|---|---|
| EP | 3 050 603 | A2 | 8/2016 |
| JP | 53-78174 | U | 6/1978 |
| WO | 2006/066423 | A1 | 6/2006 |
| WO | 2007/090310 | A1 | 9/2007 |
| WO | 2016/037940 | A1 | 3/2016 |

* cited by examiner e)

POLE HANDLE AND POLE COMPRISING SAID POLE HANDLE

CROSS REFERENCE TO RELATED APPLICATIONS

This application is a National Stage of International Application No. PCT/EP2019/060341, filed Apr. 23, 2019, claiming priority to Swiss Patent Application No. 00563/18, filed May 4, 2018.

TECHNICAL FIELD

The present invention relates to a pole handle, in particular for walking sticks, trekking poles, alpine ski poles, cross-country skiing poles, Nordic walking poles. The pole handle has a handle body with a hook-like device for attaching a hand holding device, in particular in the form of a hand strap or glove. Furthermore, the present invention concerns a pole with such a pole handle and a method for mounting such a pole handle.

STATE OF THE ART

In such a device, which is known for example from U.S. Pat. No. 5,516,150, a hook is provided on the stick handle, and on the associated glove, in the area between thumb and forefinger, a rigid bracket-shaped device formed from a rigid metal arch is provided. The bracket is inserted with its long straight leg into a narrow slot of the hook, and the hook-like device is used to fix the bracket and thus the glove to the pole handle.

A slight widening of the slot is provided in the bottom of the hook, which means that the bracket first presses the two legs of the hook slightly apart when it is inserted into the hook (material deformation) and that the legs only return to their original position when the bracket has been pushed into the widening.

Thus an elastic deformation of the hook-like device is used to ensure easy fixation of the bracket in the hook and to prevent the bracket from slipping out of the hook.

From U.S. Pat. No. 5,110,154 a pole handle is known, in which the connection between the pole handle and a hand holding device is established by inserting a stiff ring or bracket attached to the hand holding device into a recess in the form of a horizontal slot in the surface of the handle facing the hand holding device. This slot is perpendicular to the axis of the handle and must be narrow for good fastening. It is correspondingly laborious to insert the hand holding device or the stiff bracket attached to it into this slot for fastening to the pole handle. For this purpose, the bracket must be precisely positioned relative to the slot, which is not practical in practice.

From WO2006/066423 a pole handle is known, in particular for walking sticks, trekking poles, alpine ski poles, cross-country ski poles, Nordic walking poles, with a handle body and with a hook-like device for fastening a hand holding device, in particular in the form of a hand loop or glove. In the region of the hook-like device, latching means are arranged in such a way that a loop-shaped, ring-like or eyelet-like device which is pushed into the hook-like device from above and is provided on the hand holding device is fixed in the hook-like device in a self-locking manner. For removing the loop-shaped, ring-shaped or eyelet-shaped device from the hook-like device, a push button is provided in the handle head with which the locking means can be moved or rotated in such a way that they release the previously enclosed area and the device can be removed again at the top. This self-locking mechanism with release mechanism facilitates handling, but is relatively complex and not suitable for all target groups.

A similar stick handle is known from the WO2007/090310, but here the device for self-locking attachment comprises at least one recess for receiving a coupling element provided on the hand holding device, in particular preferably in the form of a bow or loop, the device having a clamping element and the recess of the device being exposed in such a way in an insertion position of the clamping element, in that the coupling element of a hand holding device not connected to the stick handle can be inserted into this recess, and wherein the device can be brought into a locking position in which the recess is closed and the coupling element is captured in the recess by tilting or sliding the clamping element.

Further handle constructions of other types are known from the following documents: JP S53 78174 U, WO 2016/037940, EP 2 046 158; EP 3 050 603; EP 1 970 105; US 2013/140803.

PRESENTATION OF THE INVENTION

It is the purpose of the present invention to provide an improved pole grip, in particular for walking sticks, trekking poles, alpine ski poles, cross-country skiing poles, Nordic walking poles. The stick handle should be improved in particular with regard to operating safety, i.e. reduce the risk of injury to the user, e.g. in the event of a fall, without restricting the actual functionality when used as intended without a fall situation or similar.

This task is solved by the stick handle defined in claim 1.

The present stick handle has a handle body and a hook-like device for fastening a hand holding device, in particular in the form of a hand loop or glove. In the area of the hook-like device, displaceable latching means are arranged in such a way that a loop-shaped, ring-like or eyelet-like device, which is provided on the hand holding device and is pushed onto the hook-like device substantially from above, is fixed on the hook-like device in a self-locking manner. Typically, the hook-like device is located on the upper part of the stick handle on the hand side.

The hook-like device comprises a holding mandrel or holding pin, which is set off from the handle body to the side of the hand, forming an insertion slot open at the top, or is arranged as an incision in the handle body. The latching means are typically designed in the form of a retaining lug, which, in the clamped position, defines a downwards area for the loop-shaped, ring-like or eyelet-like device which is restricted by the retaining lug against a force.

In particular, such a pole handle is now characterized by the feature that an upper area of the holding mandrel or holding pin or the entire holding mandrel or holding pin, viewed in the direction of walking of the user, can be deflected laterally to both sides against a restoring force.

In a typical fall situation, a lateral load is applied to the attachment point of the hand holding device on the pole handle, sometimes in the sense of a rotational movement. In concrete terms, for example, the pole is released in a fall and the hand rests on the ground, with the pole lying laterally under or next to the hand of the user. In this situation, a load is not exerted downwards on the holding pin as in normal use, but a lateral load or, to a certain extent, a rotational movement takes place. In order to release the connection between the hand holding device in the sense of a safety release and to reduce the risk of injury during such a rotational movement or lateral loading, without at the same time facilitating unintentional release during intended use, i.e. under loading of the hand strap in a downwards direction, it is possible, as suggested by the invention, to design the retaining pin or retaining mandrel according to the characterizing part of the claim.

The proposed solution is on the one hand suitable in terms of functionality, but on the other hand sufficiently simple to be technically feasible at reasonable cost. In addition, the technical solution is capable of taking into account the different conditions of the intended use without limiting the functionality. Especially in the alpine area, such stick handles are used at very different temperatures, for example in a temperature window of −30° C.-+30° C., and the proposed solution allows, among other things, to adjust the release force of the safety mechanism so that it is essentially independent of temperature. It is also possible to prevent, for example, snow or water from entering and subsequently freezing, which would restrict functionality.

A first preferred embodiment of the proposed pole grip is characterised in that the holding mandrel is attached to or moulded onto a mandrel block, and the mandrel block is mounted directly or indirectly on the grip body so as to be rotatable about a rotation axis against a force or restoring force. The rotation axis is preferably substantially perpendicular to the stick axis and oriented substantially in the walking direction. The axis of rotation need not be exactly perpendicular to the stick axis and parallel to the walking direction. Typically, it is preferably arranged substantially exactly parallel to the plane spanned by the walking direction and the stick axis, or arranged in this plane, but it can also be slightly inclined, for example, to form an angle in the range of 70-110°, preferably in the range of 80-100° with the stick axis.

Another preferred embodiment is characterised in that the axis of rotation is located below the locking area for the loop, ring or eyelet shaped device, in particular preferably 2-25 mm, or 10-15 mm or 5-12 mm below this area. This ensures the optimum lever forces for the safety release mechanism, and the whole construction is housed in the ideal location without any disturbance and hardly noticeable when handling the handle according to the intended use not requiring safety release.

The mandrel block may comprise an upper portion formed by the holding mandrel and a lower portion, the lower portion having a front surface (facing in the direction of travel) in contact with a contact surface on the handle body or on a holding block (typically mounted in or on the handle body). Furthermore, preferably an axis passing through these surfaces can be provided. Preferably, these surfaces slide against each other in the event of lateral deflection of the mandrel block, at least during a portion of the rotary movement of the block which takes place when it is released. Preferably, the axial length of the lower part is at least as great as the axial length of the upper part formed by the holding mandrel, in particular preferably 1-2 times as great. In order to control the rotary movement or to adjust the force ratios, it is possible to structure the surfaces lying against each other in such a way that the surfaces slide against each other only in a first phase of rotation, and after a certain deflection angle has been reached, further rotation is only possible when the mandrel block has additionally been displaced slightly outwards from a corresponding recess in the handle body essentially along the axis of rotation.

In the handle body or in the holding block a horizontal first passage opening in the walking direction and in the mandrel block a coaxial second passage opening can be provided, and a fastening pin/screw can be arranged as a rotation axis passing at least partially through the first and second passage opening in order to technically realize such a rotation. A contact surface on the handle body or on the holding block and a front contact surface on the mandrel block can have corresponding locking contours which, via at least partial positive locking, define a basic position in which the holding mandrel is arranged vertically (i.e. substantially parallel to the shaft axis) and which allow lateral deflection only after a release force has been reached. A lateral maximum stop is preferably additionally provided for rotation.

Furthermore, the fastening pin can preferably be fixed in the mandrel block, for example by being pressed in, glued in, screwed in or a combination of these. A free end of the fastening pin facing the handle body and protruding over the mandrel block can, according to another preferred embodiment, pass through the first through opening and be locked against axial displacement in an extension area behind it inside the handle head by means of a fastening element. The fastening pin can also be prevented from moving beyond the intended position by an appropriate shape corresponding to the expansion area of the mandrel block.

Preferably, the fastening element has an at least partially hollow cylindrical area located in the first passage opening and an enlarged area behind it with a larger diameter than the diameter of the first passage opening.

In such a construction, it is also possible for the fastening element to be at least partially self-locking when the fastening pin is inserted. Furthermore, it is also preferably possible for this fastening element to be designed as part of the mandrel block, for example as a hollow cylindrical extension directed towards the handle head with one or a plurality of axial slots, the free ends of the axial segments thus formed having flange segments directed outwards.

If, in such a construction, the mandrel block is inserted to a certain extent into the opening in the handle head, these flange segments can move flexibly inwards and thus the mandrel block can be inserted and fixed, and if the fixing pin is then inserted into the central opening, this fixing can no longer be released without removing the fixing pin.

According to another preferred design, a fixing block can be arranged in a recess of the handle body above the holding block, in which the locking pin is displaceably mounted, and which fixing block is mounted in the recess so as to be partially rotatable against the force of a spring. The mandrel block is preferably rotatably mounted on the holding block, and the fastening block has a downwardly directed, preferably V-shaped extension in the area facing the mandrel block. This engages in a preferably likewise V-shaped recess in the mandrel block, so that when the mandrel block is deflected sideways, the extension is shifted upwards and the fastening block is tilted in the recess against the force of the spring.

Thus, in such a design, the mandrel block, holding block, fixing block and a release button, which is also arranged at least partially in the recess and is preferably located at the upper head end of the handle and can be actuated by the user to release the loop in a controlled manner, are designed as a connected unit which is preferably prefabricated and can be inserted as a whole into the recess and fixed therein.

The handle body may have a horizontal first through opening in the running direction and a coaxial blind hole opening in the mandrel block, and a bracing pin may be arranged as an axis of rotation passing at least partially through the first and second openings. The bracing pin can be designed to be movable against a spring force out of the handle body.

Furthermore, preferably a contact surface on the handle body and a front contact surface on the mandrel block can have corresponding detent contours and/or also lateral boundary surfaces, which, via positive locking, specify a basic position in which the holding mandrel is arranged vertically and which allow lateral deflection only after a release force is reached. The latching contours can be provided, for example, in the form of depressions and corresponding elevations in the contact surfaces in contact in the basic position, preferably in the form of at least one calotte-shaped elevation and corresponding calotte-shaped depression. For example, these latching contours can be arranged vertically below or above the bracing pin.

Furthermore, the bracing pin can preferably be fastened in the blind hole opening by means of a fastening eyelet and a fastening pin, for example at the area projecting into the handle body it can be embraced at least in sections by a spiral spring loaded in compression, whereby for example the spiral spring can rest on an extension arranged behind the first passage opening, and preferably be limited at the free end by an end element.

According to another preferred embodiment, a mounting block is arranged in a recess of the handle body, in which the locking pin is slidably mounted.

According to another embodiment, the bracing pin can pass through a through-hole in a lower extension of the mounting block.

A lower portion of the holding mandrel may be formed according to another preferred embodiment on the handle body from a substantially non-flexible material, and an upper portion from a flexible material which can be deflected against a restoring force, preferably the lower portion reaching vertically above the lowest point of the area for the attached loop/eyelet, preferably ending 1-3 mm above. It is thus possible, for example, to form the lower portion from a material which is substantially rigid at the usual temperatures of use, while the upper portion, or at least a transition portion between the lower portion and the upper portion, consists of a material which is flexible at the usual temperatures of use, in other words a material which, at the release force, allows the entire upper portion of the retaining mandrel to deflect. Alternatively, the flexibility of the holding mandrel, e.g. in such a transition area, can also be produced by a flexurally elastic element, e.g. by a leaf spring or a helical spring, e.g. of spring steel, i.e. the flexible material can also be such a flexurally elastic element.

Typically, the material of the lower area has a greater Shore D hardness than the material of the upper area or transition area. If there is a flexible transition area, the upper area can be made of a material of the same hardness as the lower area.

Such a stick handle with a flexible holding mandrel can preferably be characterized in that in the transition region between the lower region and the upper region, the material of the lower region extends at least partially into the upper region in the form of an extension extending along the direction of the holding mandrel, and the material of the upper region surrounds this extension at least partially, preferably completely, circumferentially around this extension, wherein furthermore preferably the extension has a cylindrical, parallelepipedic shape, with or without rounded edges, with or without additional extension at the free end, with or without serrations.

Preferably, the safety mechanism is designed in all spatial directions with the exception of the intended downward loading of the hand strap. In other words, not only an upward safety release, which is already known from the state of the art, and a safety release for lateral loading as described above, is provided, but also an additional safety release when the hand strap is loaded to a certain extent to the rear, against the walking direction. A further preferred design is accordingly characterised by the fact that the holding mandrel is attached to a mandrel block or moulded onto it, and the mandrel block is mounted directly or indirectly on the handle body so as to be rotatable about a first axis of rotation against a restoring force. This first axis of rotation is substantially perpendicular to the stick axis and is oriented substantially in the walking direction. According to this further aspect of the invention, the mandrel block is now additionally mounted so as to be tiltable about a second axis of rotation, which is aligned substantially perpendicular to the stick axis and substantially perpendicular to the walking direction, i.e. quasi transverse to the first axis of rotation, by an angle of at most 30°, preferably of at most 15° or of at most 10° or 5°.

Preferably the second axis of rotation is located below the first axis of rotation.

Furthermore, preferably during the tilting movement about the second axis of rotation, the restricted area for the loop, ring or eyelet shaped device is released, whereby this can be done at least partially by a displacement of the fastening block caused by the tilting movement with the locking pin retained. In particular, this can be technically realized in such a way that when the hand loop and thus also the mandrel block is pulled backwards, the fastening block is also displaced slightly backwards, but at the same time the locking pin is held stationary by the release button or the slotted link provided therein, and is therefore retracted relative to the fastening block, thereby releasing the restricted area for the loop-shaped, ring-shaped or eyelet-shaped device.

Another preferred design is characterised by the fact that a separate mounting block with a locking pin and guide of the locking pin is mounted in a recess of the handle body, which is preferably designed as a recess running in the direction of travel so that the head area is formed laterally by the handle body, and is preferably mounted so as to be rotatable or pivotable about an axis (preferably oriented perpendicular to the stick axis and perpendicular to the direction of travel). Furthermore, a release button can preferably be provided, preferably at the upper head end and to be actuated from above, with which either the fastening block as a whole can be tilted to release the loop and/or the locking pin can be pushed back into the interior of the fastening block to release the loop via a corresponding slotted link on the release button and a transverse pin preferably guided transversely through the locking pin.

The hook-like device preferably comprises a holding mandrel or holding pin arranged substantially parallel to the stick axis, which is set off from the handle body to the hand side by forming an insertion slot or is arranged as an incision in the handle body, the depth of the insertion slot preferably being greater than the width and the thickness of the holding mandrel or holding pin.

The hook-like device preferably has a width in the range of 3-15 mm, preferably in the range of 4-8 mm.

Preferably, the hook-like device has a substantially oval or lenticular cross-section at least in sections perpendicular to the stick axis, with the short main axis directed towards the handle body.

For example, the insertion slot has a depth in the range of 5-30 mm, preferably in the range of 10-15 mm.

Furthermore, the retaining lug is preferably designed in the form of a locking pin, which is displaceably mounted in the handle head or in a fastening block mounted in the handle head and is oriented in the walking direction and which is preferably oriented substantially horizontally or sloping in the walking direction, the front area of the locking pin having a concave depression, for example in the form of a groove running horizontally and transversely to the running direction, on the underside facing the area for the fastened loop or eyelet.

The pole grip can have a lower grip body area, which forms a lower grip area of the pole grip and has a recess for a pole tube at the lower end, and a head area, the head area having a front extension, which merges substantially without a step into the upper grip area in the front pole grip area, the extension in the front pole grip area being formed with a projection in the walking direction beyond the grip area.

The projection is preferably more than 50% of an average extension of the grip area in the direction of travel. A cut plane of the head region, which is defined by a transverse axis of the head region disposed transversely to the longitudinal axis of the stick and transversely to the direction of walking (the transverse axis being disposed where the head region is widest measured transversely to the direction of walking and transversely to the longitudinal axis of the stick) and a foremost tip of the extension, is preferably angled at an obtuse angle of in the range of 90-135 degrees from the longitudinal axis of the stick.

The head region preferably has a rounded contour in this sectional plane, the front section of which facing the direction of travel is preferably defined substantially by an arc of a first circle and the rear section of which, opposite the direction of travel, is substantially defined by an arc of a second circle, the centres of which are offset from one another along the direction of travel by an offset of 0.5-6 cm, the radius of curvature of the first circle being smaller than the radius of curvature of the second circle in the rear pole grip region.

Furthermore, the present invention relates to a stick, in particular a walking stick, trekking stick, alpine ski stick, cross-country skiing stick or Nordic walking stick, with a stick handle as described above, a preferably one-piece stick tube or a stick which can be adjusted according to the requirements, alone or in combination with a hand holding device, in particular in the form of a hand loop or a glove, with a loop, ring or eyelet shaped device which is provided on the hand holding device.

Further embodiments are specified in the dependent claims.

BRIEF DESCRIPTION OF THE DRAWINGS

Preferred embodiments of the invention are described in the following on the basis of the drawings, which are for explanatory purposes only and are not to be interpreted restrictively.

Show in the drawings.

DESCRIPTION OF PREFERRED FORMS OF EXECUTION

Figure 1:
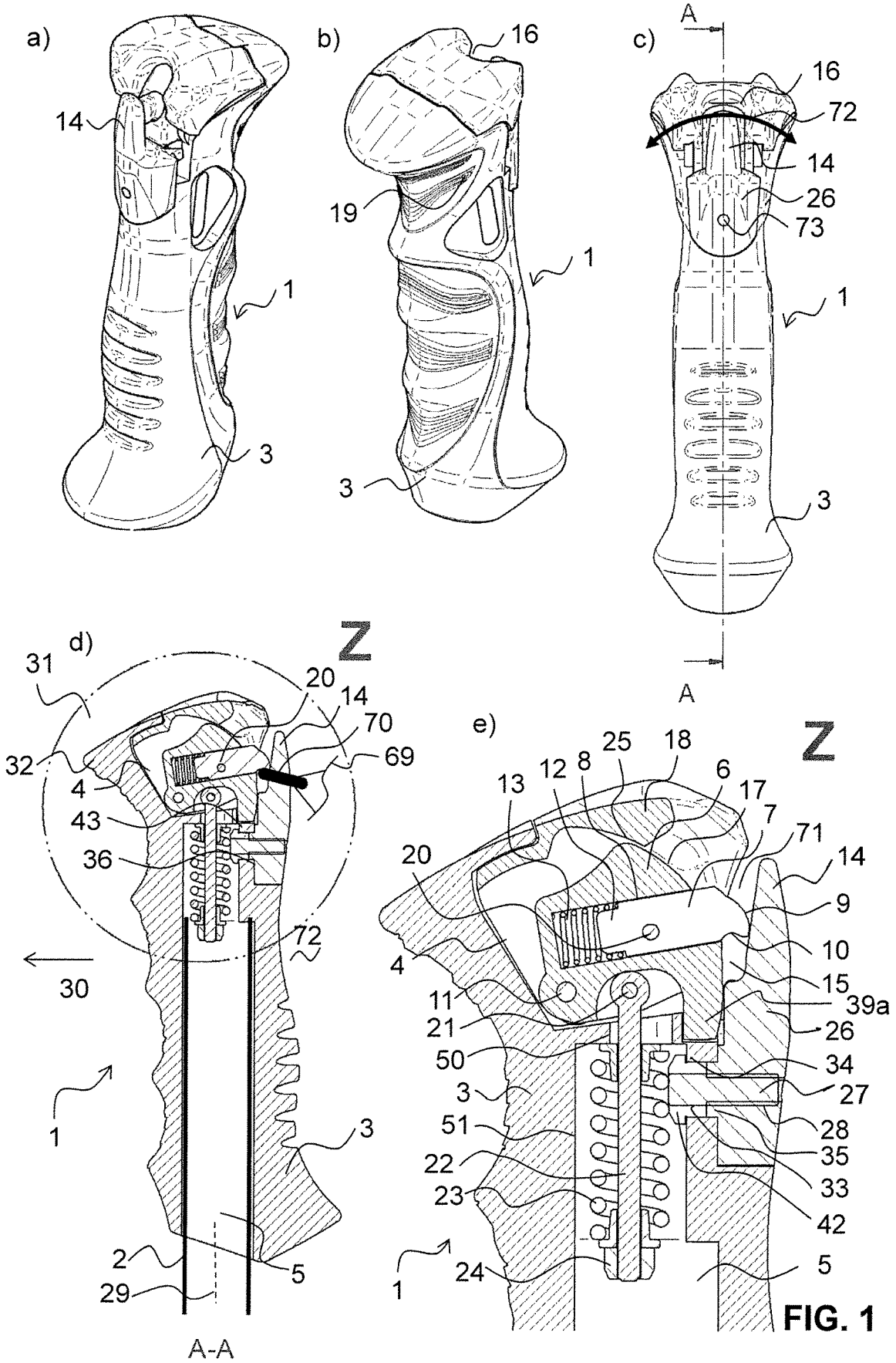
FIG. 1 a first example, whereby in a) a perspective view from diagonally rear top, in b) a perspective view from diagonally front top, in c) a view from rear, in d) an axial section along the line A-A in c, in e) the detail according to Z in d), in f) an exploded view, in g) a top view and in h) a bottom view is shown, and in i)-p) detail views of the mandrel block of this example, whereby in i) a view from below, in j) a view from the front, i.e. looking against the direction of travel, in k) a side view, in l) a section along the line X-X in figure j), in m) a view from above, inn) a section along the line B-B in figure j), in o) and p) two perspective views from diagonally behind and diagonally in front respectively.
Figure 1:
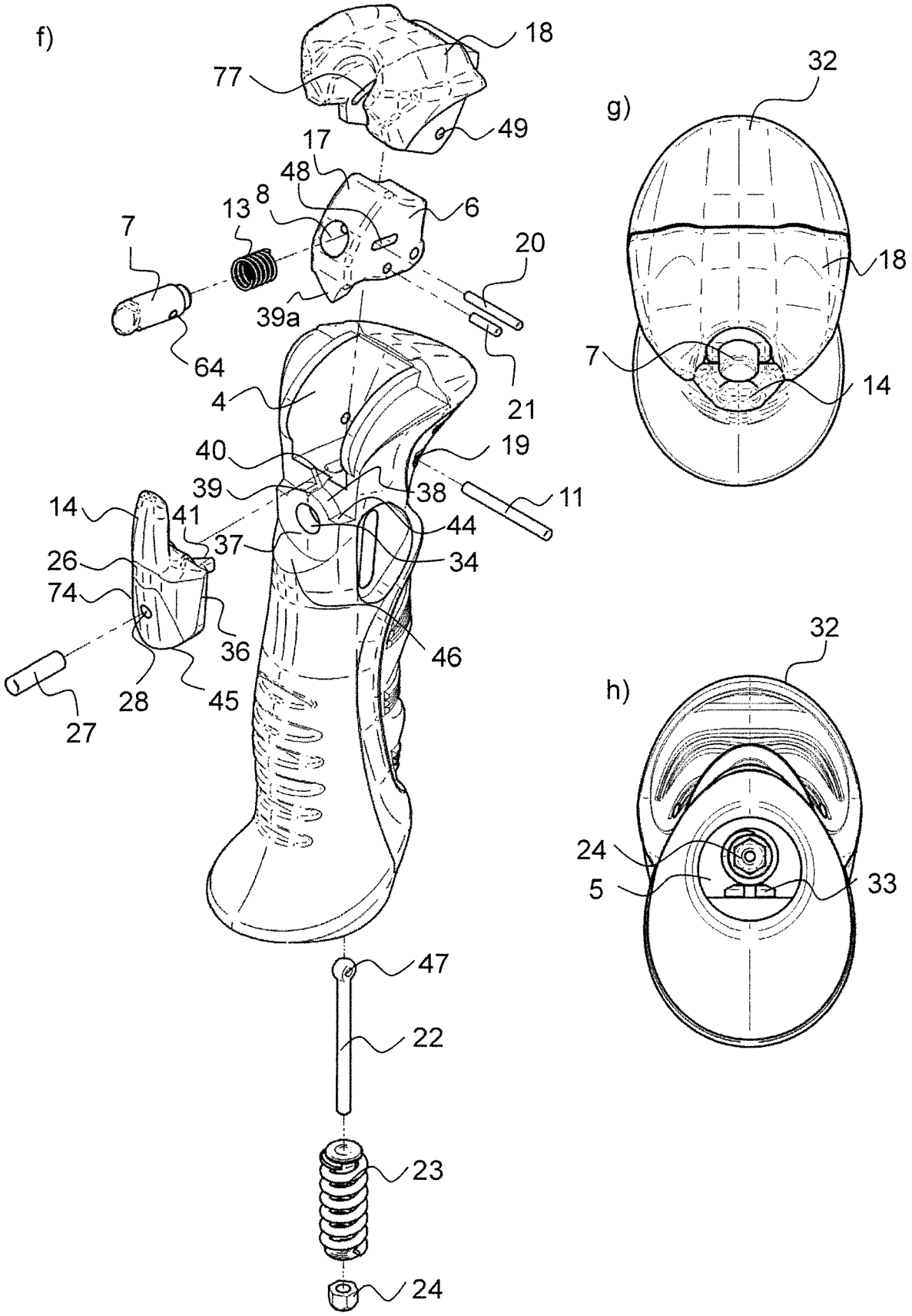
Figure 1:
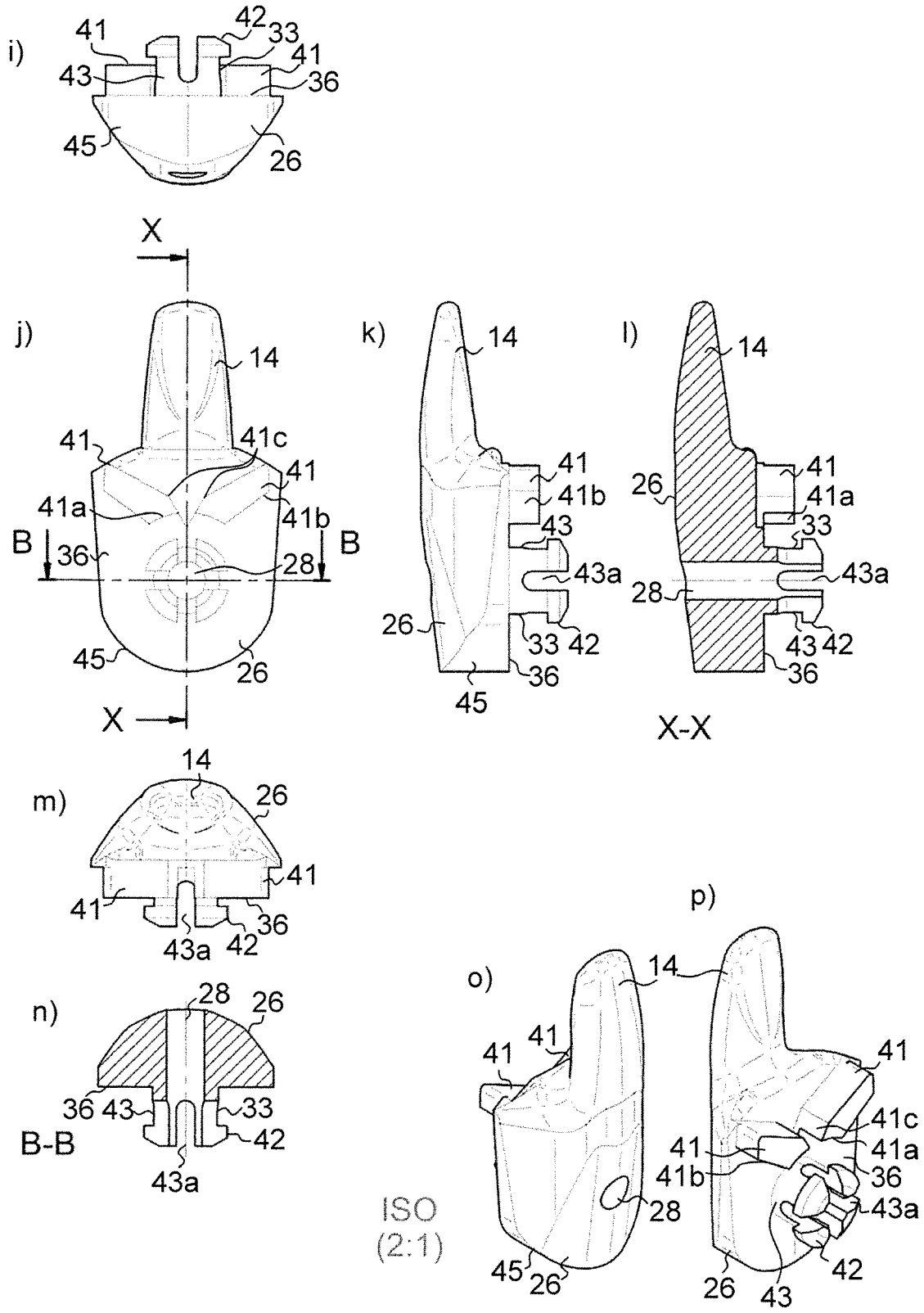
Figure 2:
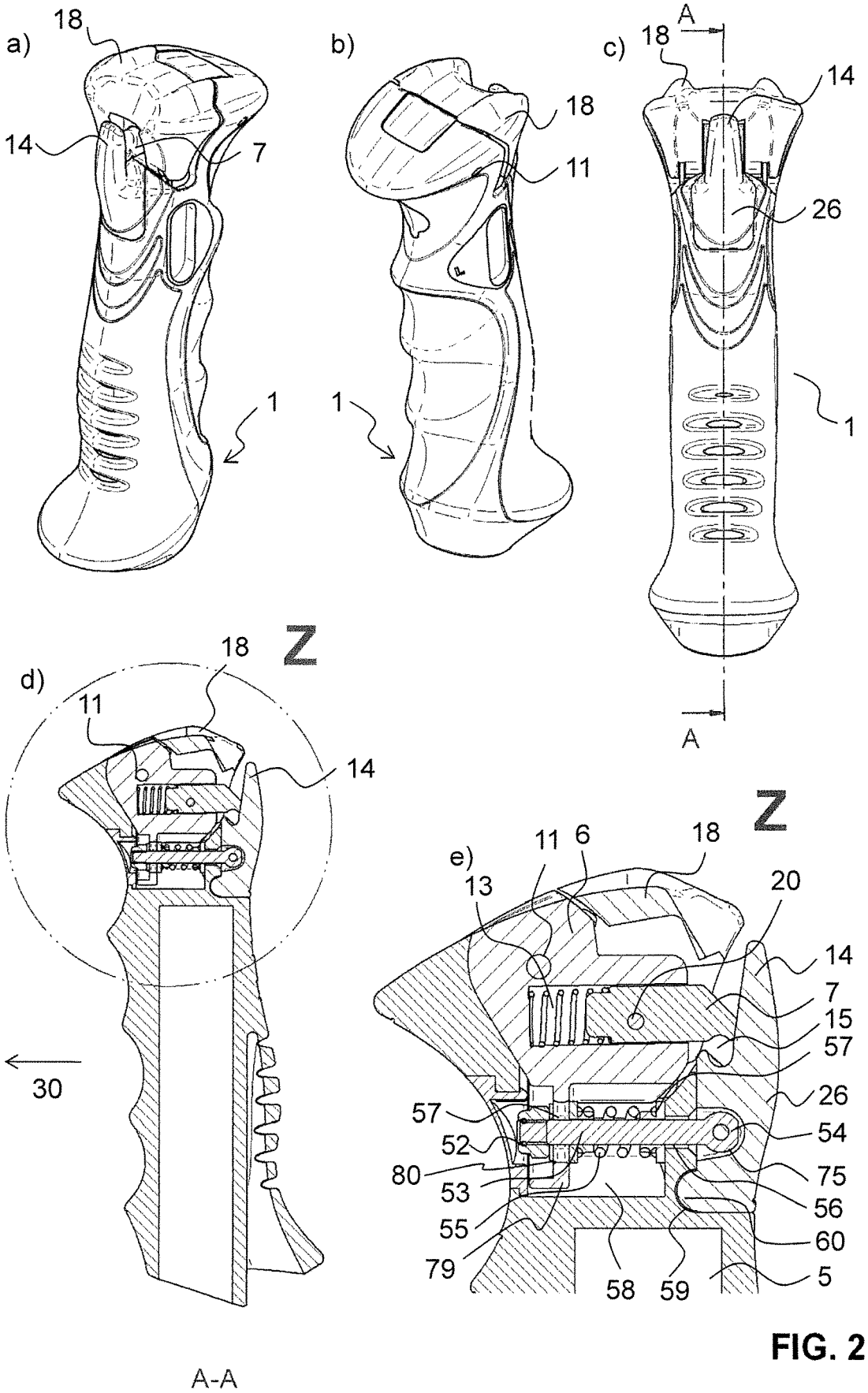
FIG. 2 is a second example, where in a) a perspective view from diagonally rear top, in b) a perspective view from diagonally front top, in c) a view from rear, in d) an axial section along the line A-A in c, in e) the detail according to Z in d), in f) an exploded view, in g) a top view and in h) a bottom view is shown, and in i)-p) detailed views of the mandrel block of this example, whereby in i) a view from below, in j) a view from behind, i.e. looking in the direction of travel from behind at the stick handle, in k) a side view, in 1) a section along the line X-X in figure j), in m) a view from above, in n) a section along the line B-B in figure j), in o) and p) two perspective views from diagonally behind and diagonally in front respectively.
Figure 2:
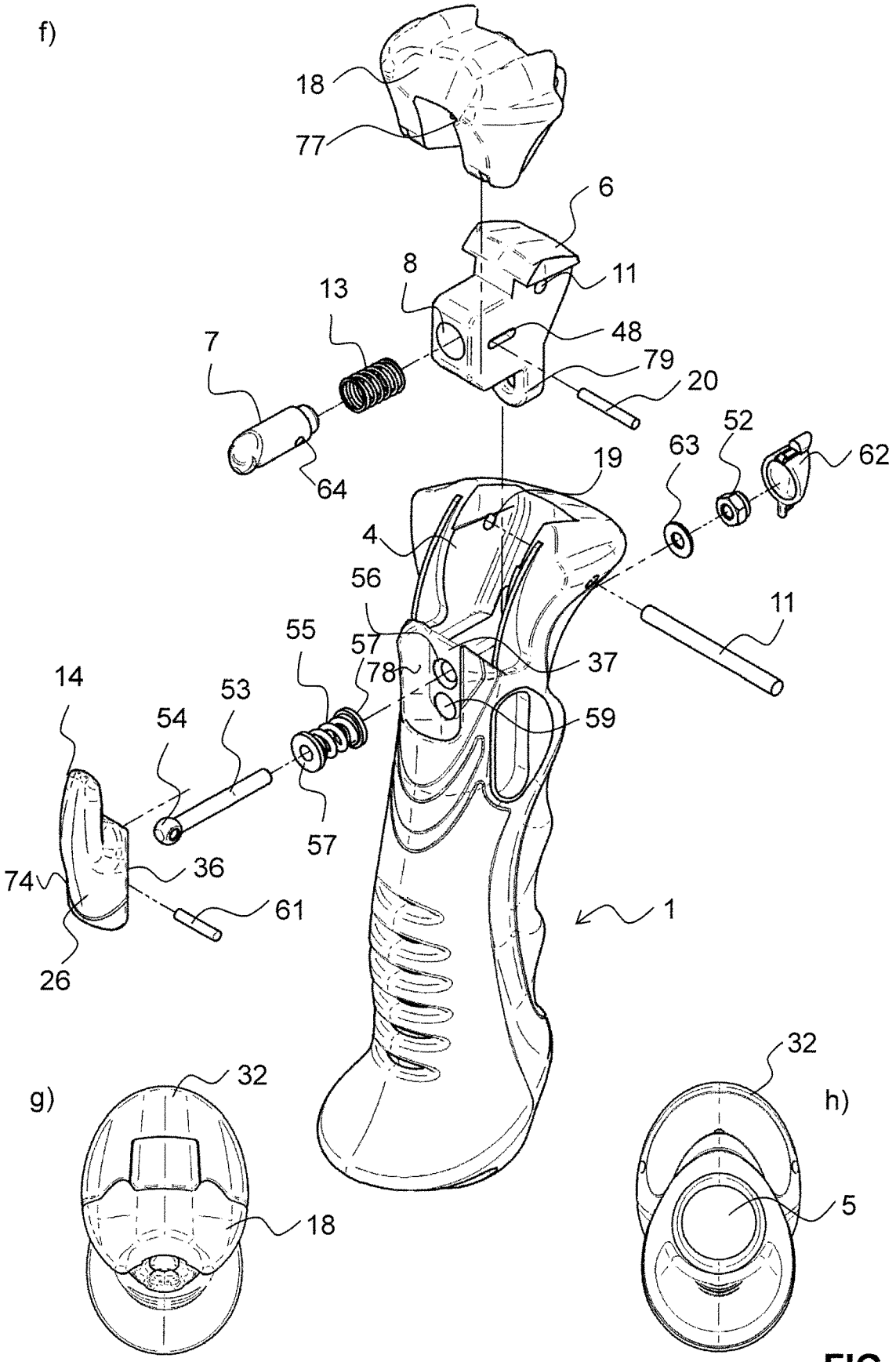
Figure 2:
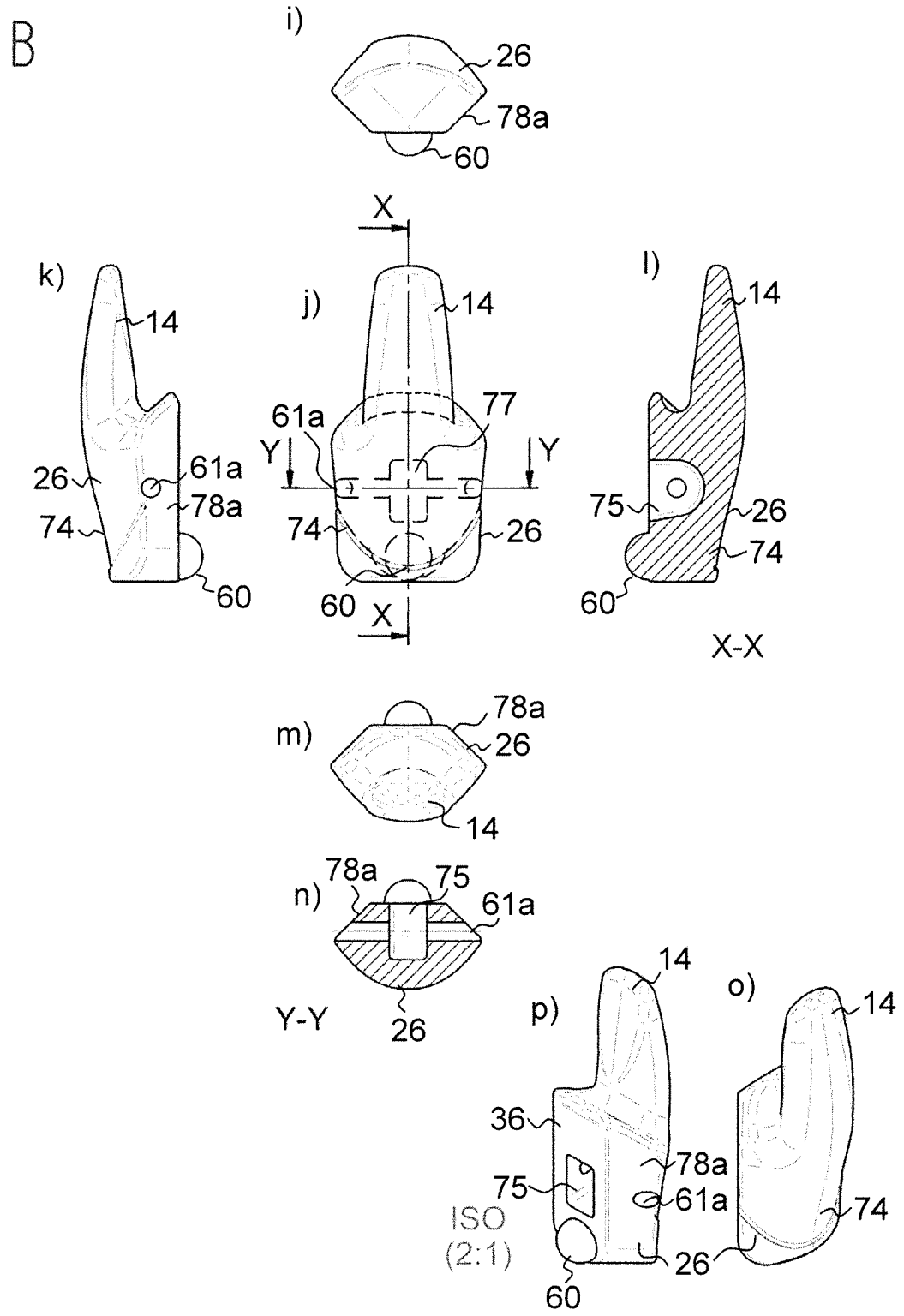
Figure 3:
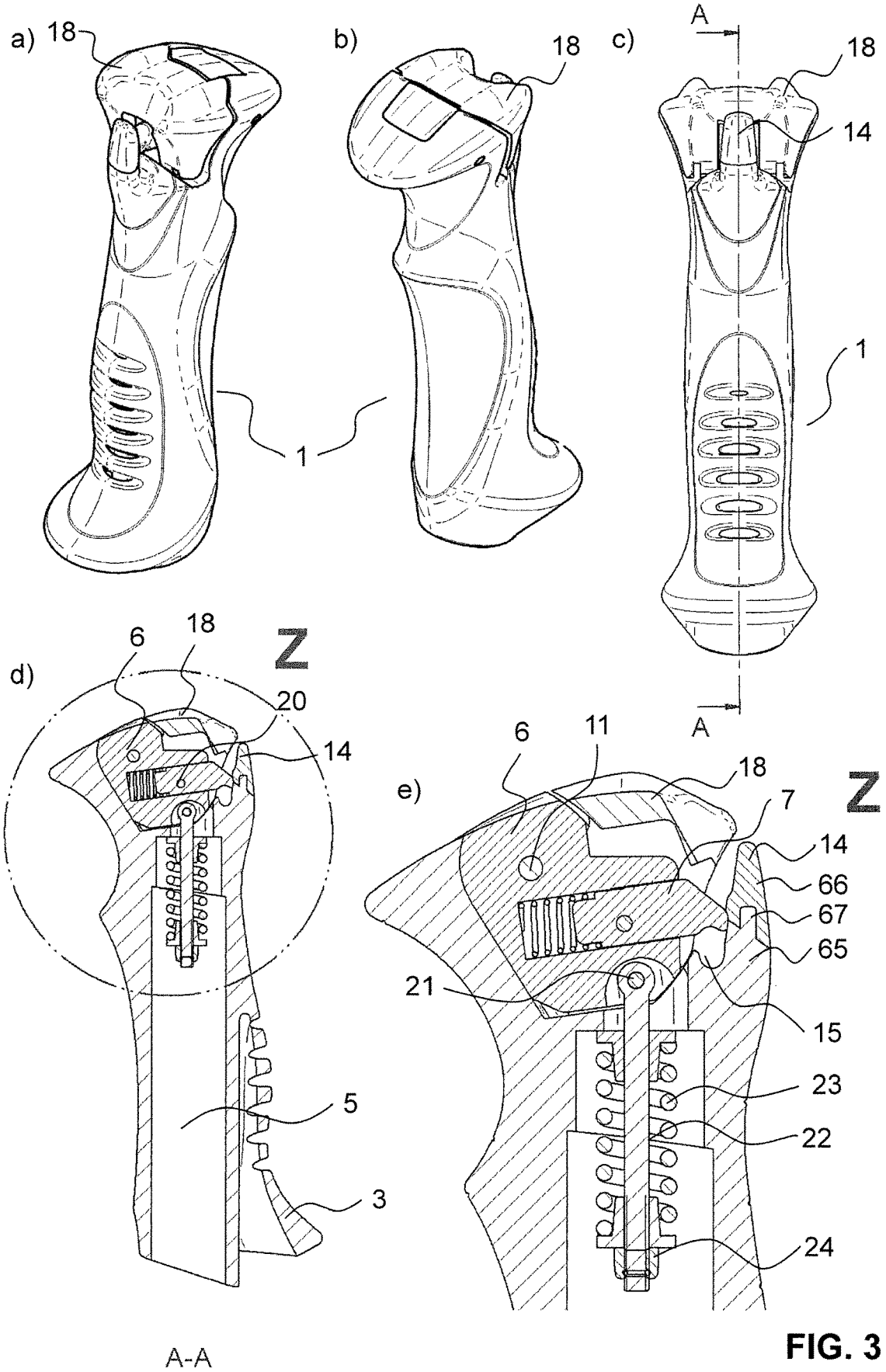
FIG. 3 shows a third example, where in a) a perspective view from diagonally back top, in b) a perspective view from diagonally front top, in c) a view from back, in d) an axial section along the line A-A in c, in e) the detail according to Z in d), in f) an exploded view, in g)-l) different possibilities of implementing the holding mandrel in 2K technology are shown.
Figure 3:
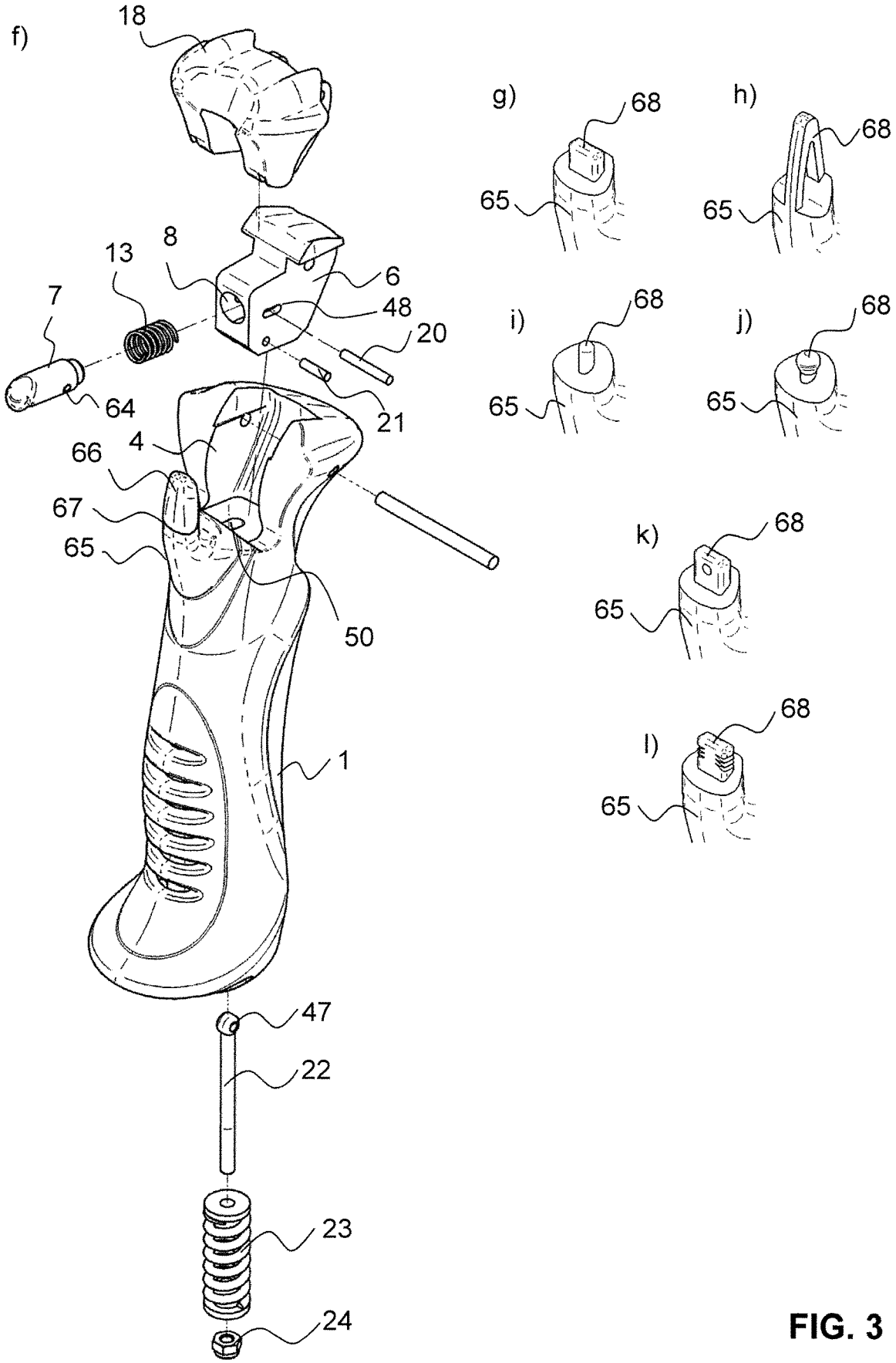
Figure 4:
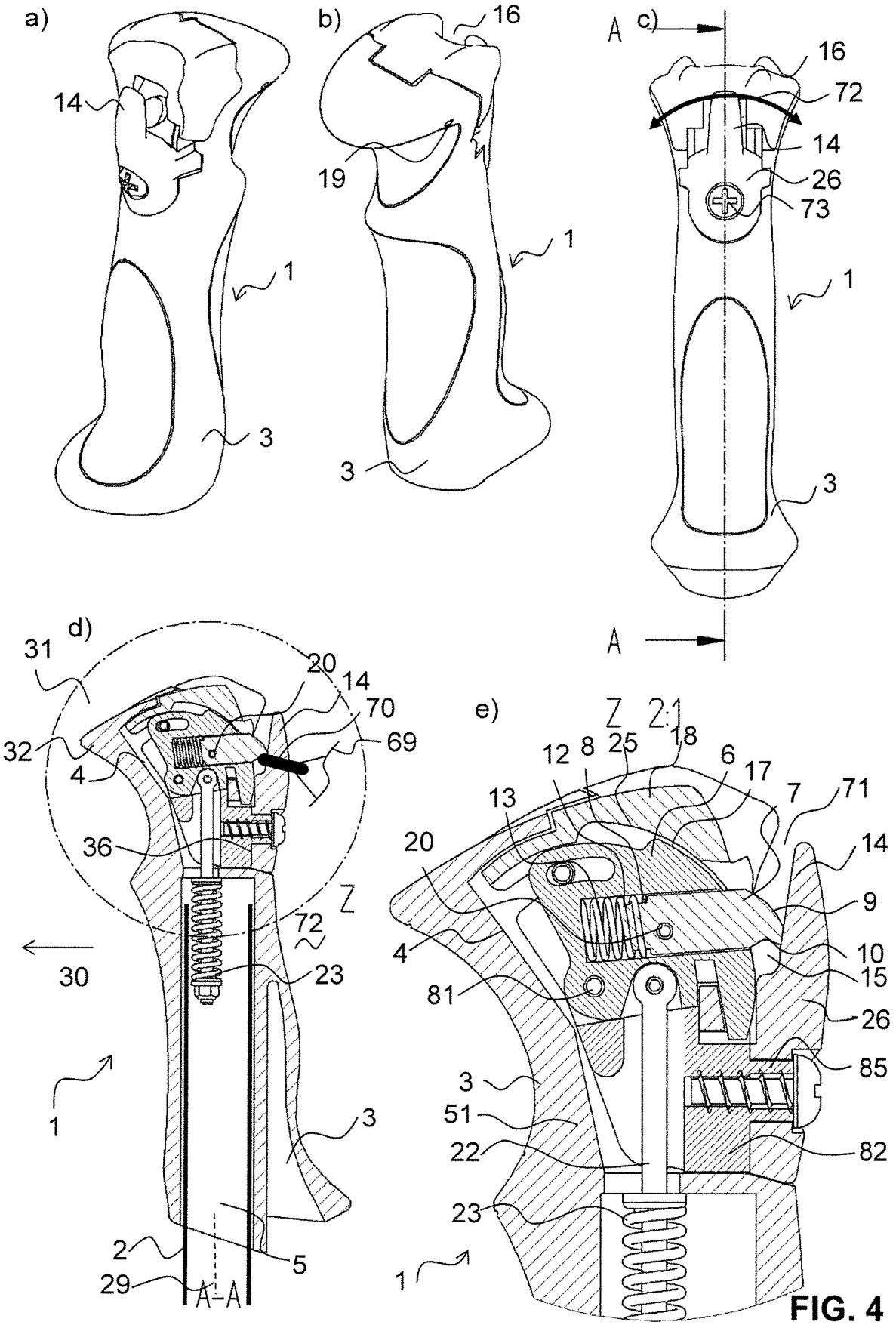
FIG. 4 a fourth example, where in a) a perspective view from diagonally rear top, in b) a perspective view from diagonally front top, in c) a view from rear, in d) an axial section along the line A-A in c, in e) the detail according to Z in d), in f) an exploded view, in g) the mounting block from diagonally above and in h) from diagonally below, each in perspective view, in i)-k) the mounting block from diagonally above, behind and in a section as indicated in j), as well as in l)-r) detailed views of the mandrel block of this design, where in l) a view from below, in m) a view from behind, i.e. looking in the direction of travel, in n) a side view, in o) a section along the line X-X in figure m), in p) a view from above, in q) and r) two perspective views from diagonally behind and diagonally in front respectively.
Figure 4:
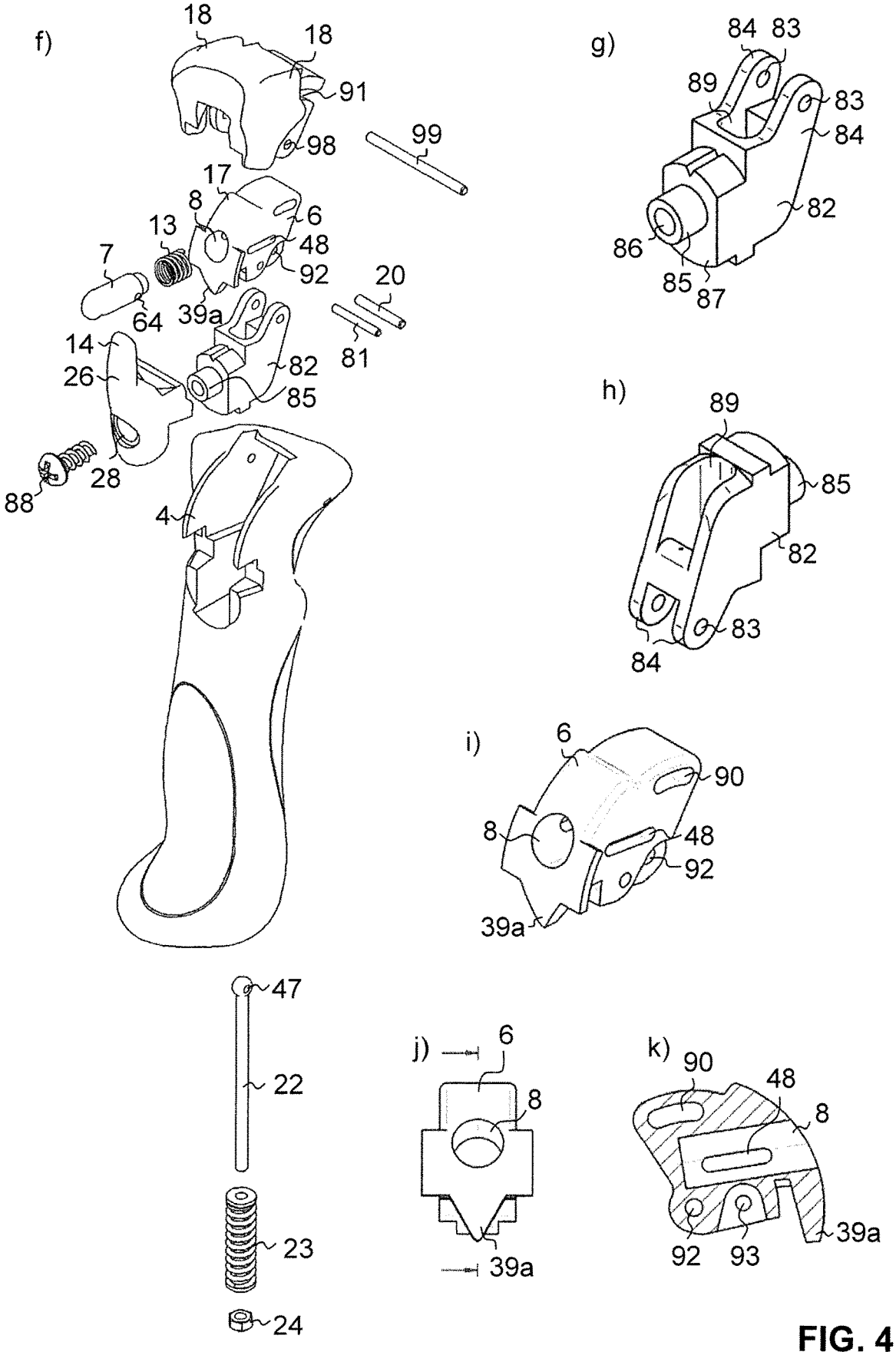
Figure 4:
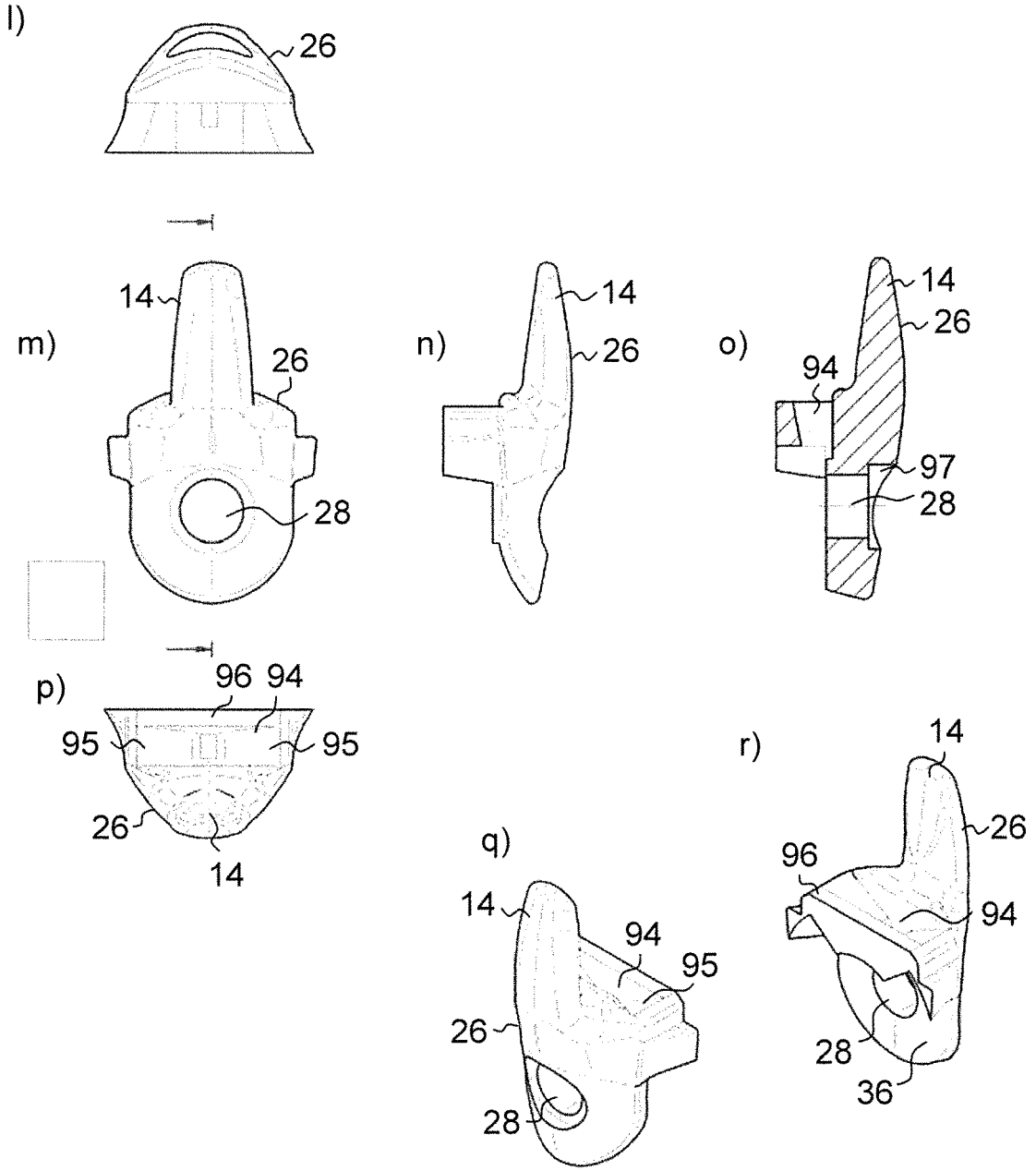
Figure 5:
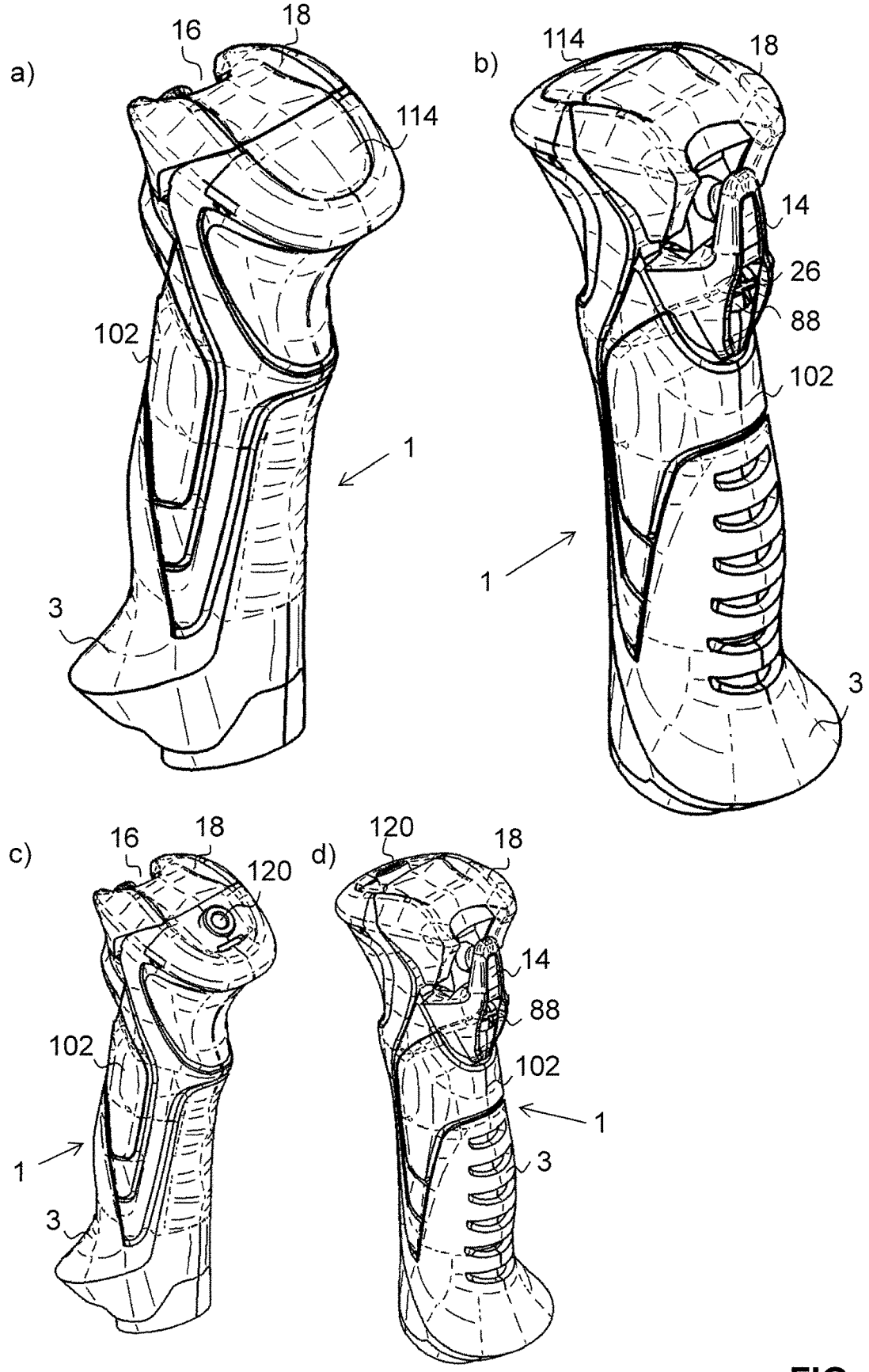
FIG. 5 fifth example, wherein in a) in a perspective view from obliquely above in front and in b) from obliquely above in the rear a stick handle with attached cover is shown, in c) in a perspective view from obliquely above in front and in d) from obliquely above in the rear a stick handle with inserted adapter piece for the attachment of accessories is shown, in e) an exploded view of the stick handle is shown, in f) a view from behind in the direction of travel, in g) an axial section along the line S-S according to FIG. 5*f*), in h) a view from below, i) a view from above with cover, j) a view from above with inserted adapter piece for attaching accessories, and in k)-r) detailed views of the mandrel block of this example, where in k) a view from below, in 1) a view from behind, i.e. looking with running direction, in m) a side view, in n) a section along the line S-S in FIG. 1), in o) a view from above, in p) and q) two perspective views from diagonally behind and in r) a section along T-T in FIG. 1).
Figure 5:
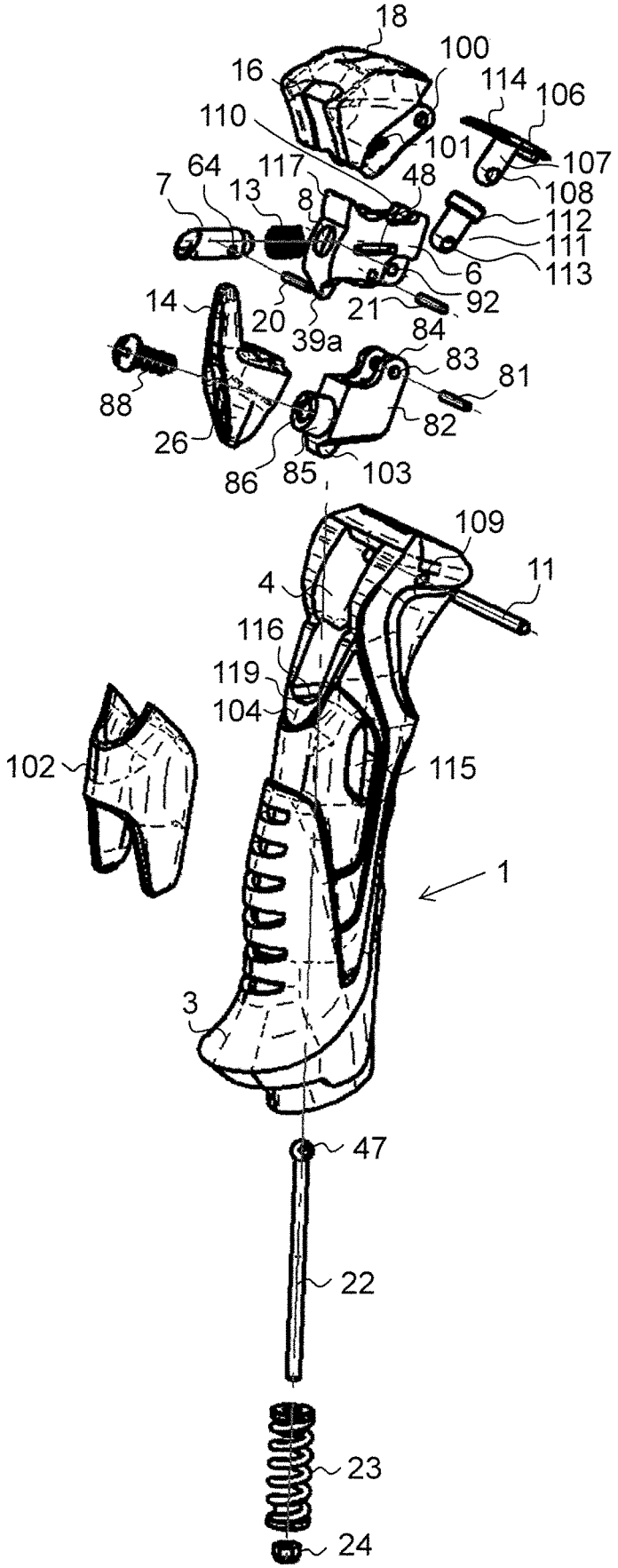
Figure 5:
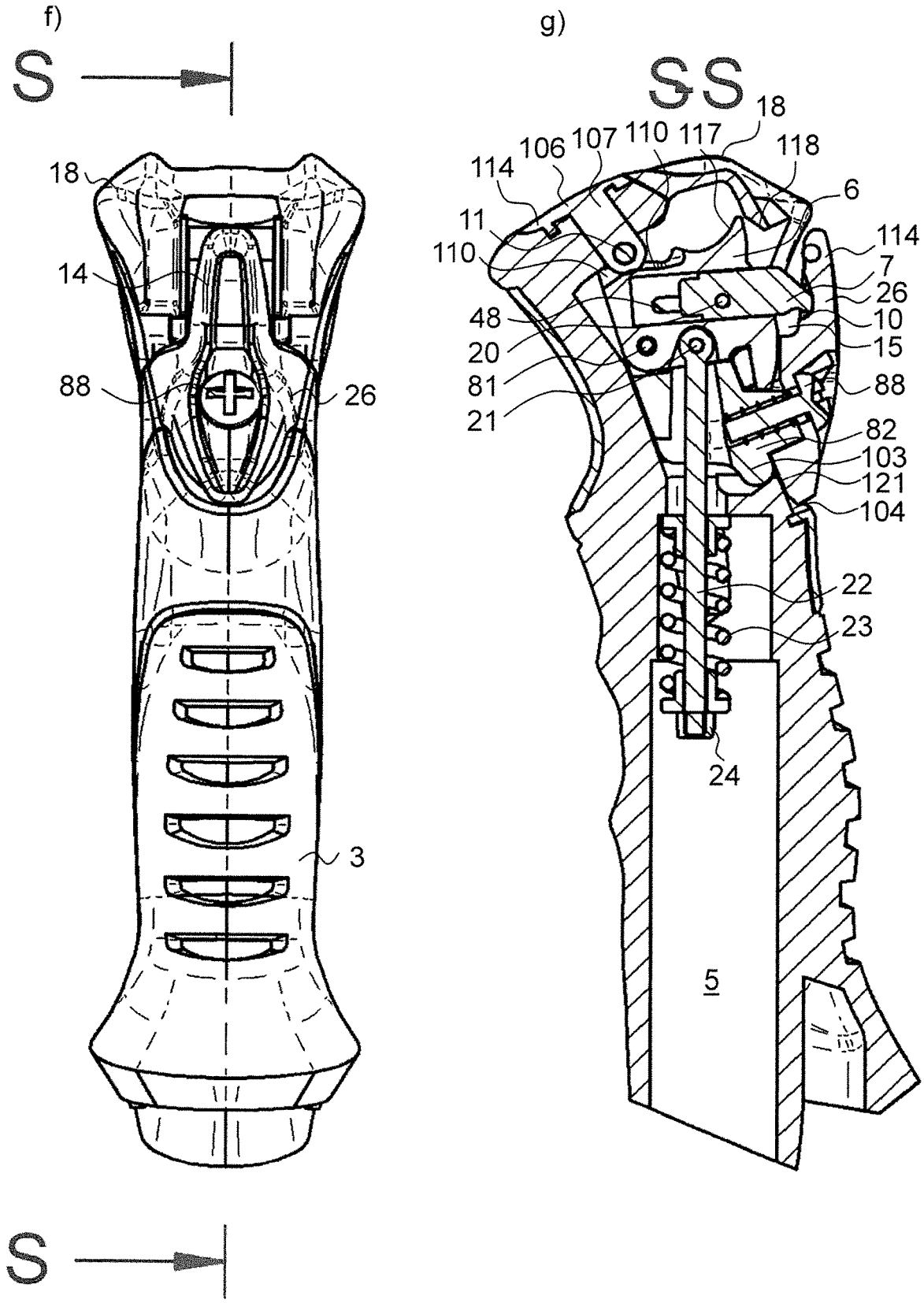
Figure 5:
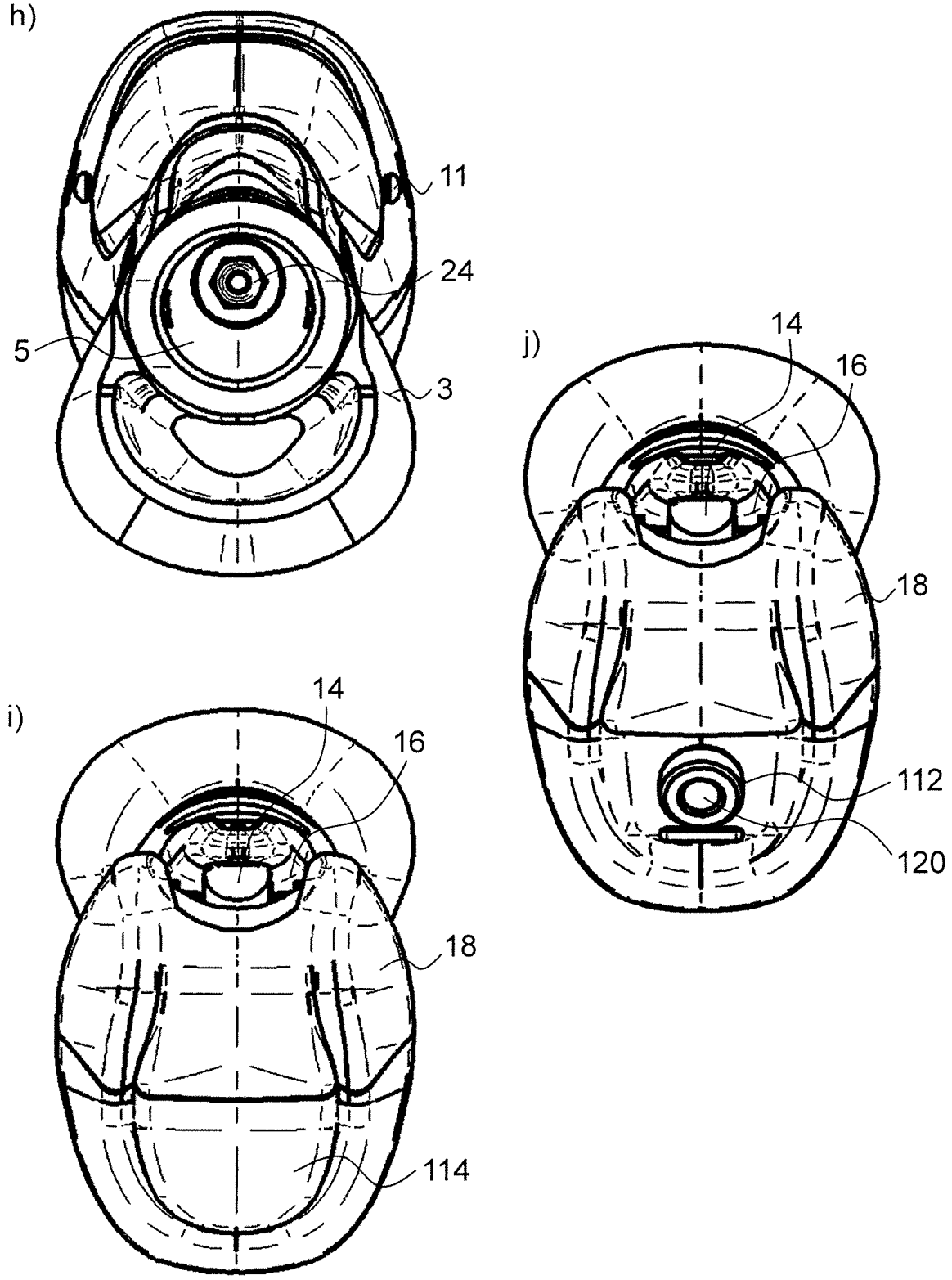
Figure 5:
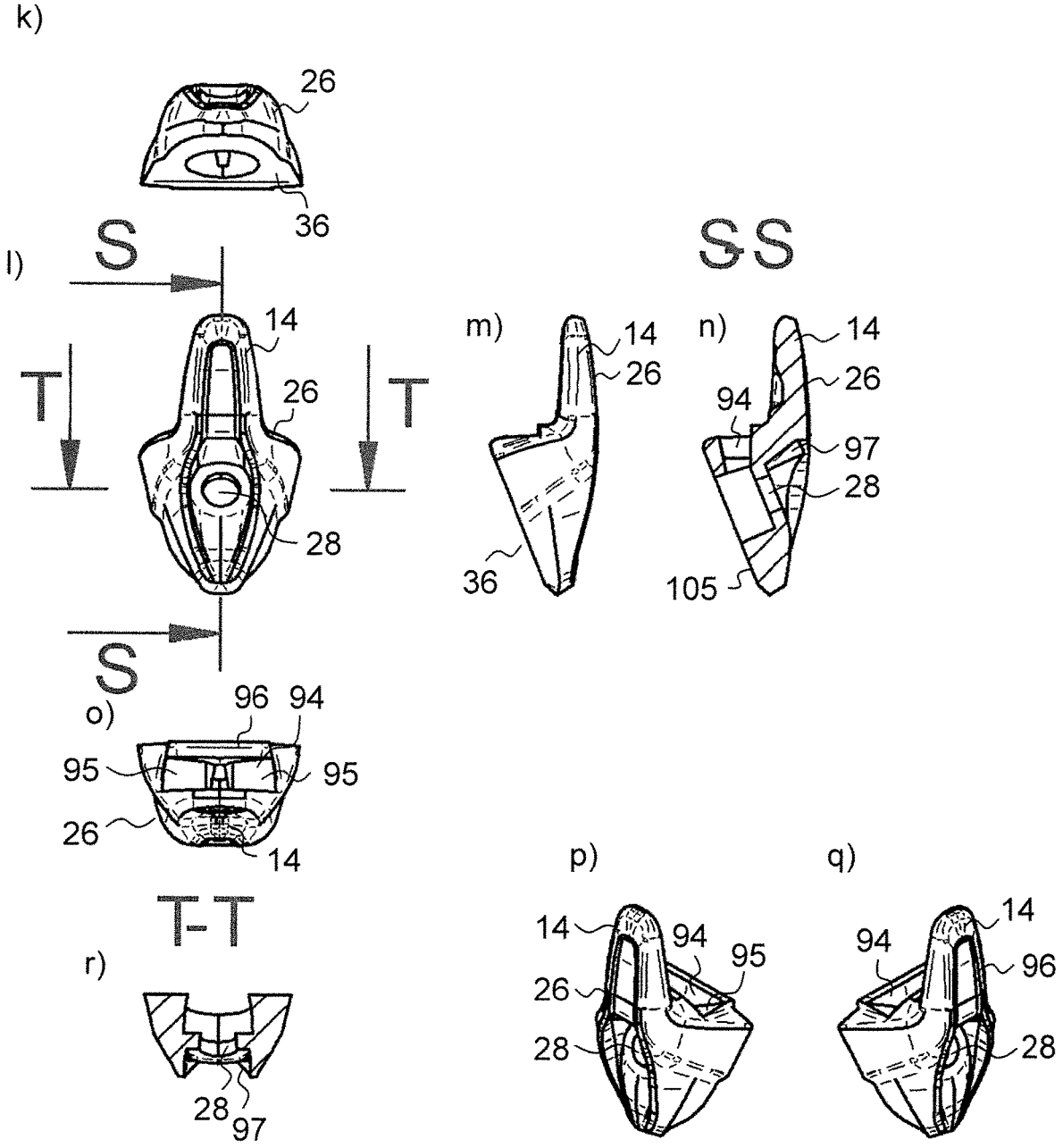

Four different examples are shown in the figures: FIG. 1 shows a first example in which the mandrel block 26 with the holding mandrel 14 can be swivelled around a defined axis of rotation 73. FIG. 2 shows an example in which such a mandrel block, when swivelled about an analogous axis, is simultaneously also displaced to a certain extent out of the stick handle, FIG. 3 shows an example in which not the holding mandrel as a whole is mechanically tilted about an axis, but only the upper area of the holding mandrel 14 can be elastically deformed/bent away, and FIGS. 4 and 5 show further examples, in which the mandrel block 26 with the holding mandrel 14 can be swivelled around a defined axis of rotation 73.

In the various examples, analogue components are marked with the same reference signs. In order to maintain clarity, not all reference numerals are given for all design examples/figures.

In the pole grip according to FIG. 1, the pole grip 1 is provided with a blind hole from below in the form of a cavity 5 for the pole tube 2. The handle body 3 has a recess 4 in the head area 31 in which a safety release for pulling upwards is provided on a loop-shaped device 70 attached to a hand holding device 69.

The loop-shaped device 70 is attached to the handle by means of the holding mandrel 14, which is located to a certain extent in a recess 16 in the handle body 3.

The holding mandrel 14 is not formed in one piece with the handle body 3, but is part of a mandrel block 26, which can be deflected sideways about a rotation axis 73 as shown with the arrow 72 in FIG. 1*c* when pulling the loop.

To make this possible, the mandrel block 26 is provided with a through opening 28, which runs essentially parallel to the running direction 30. In the handle body 3 there is a through-opening 34. Furthermore, the mandrel block 26 has a hollow cylindrical extension 33 in the area of the through-opening 28, which has axial slots and which has a quasi-circumferential flange 42 directed outwards at the end projecting through the through-opening 34 into the handle head 3. However, there is no really circumferential flange 42, but only corresponding segments separated from each other by the four distributed slots 43*a*.

Correspondingly, the mandrel block 26 can be pressed into the opening 34 in the handle body 3 during assembly with the elements 33/42, whereby the sections 42 facing outwards can be deflected inwards due to the flexibility of the sections 33. If the outwardly directed sections 42 have passed through the through-opening 34 into the inner cavity 51, they can again deflect elastically radially outwards and then hook the mandrel block 26 in the opening 34.

In order to now fix the mandrel block 26 definitely in the opening 34 in the handle body 3, a fixing pin 27 is inserted from the outside through the opening 28 in the mandrel block 26 until the inner end of this fixing pin 27 passes through the area 33. Once this fastening pin 27 has been inserted, it is no longer possible to separate the fastening block 26 from the handle body 3 without removing the fastening pin 27.

In the head area 31 of the handle body 3, a mounting block 6 is located in the recess 4. This can be rotated about a transverse axis of rotation 11 in a direction perpendicular to the stick axis and perpendicular to the running direction.

This fixing block 6 is braced downwards by the bracing pin/eye bolt 22, which is attached to the fixing block 6 by the transverse fixing pin 21. For this purpose, the tensioning pin 22 projects downwards through a through-hole 50 into an axial receiving opening 51 and is retained there by a spiral spring 23, at the free end of which the end nut 24, possibly provided with a spring end element, is retained at the free end of the tensioning pin 22.

In the mounting block 6, the locking pin 7 is also provided, which can be moved against the restoring force of a spiral spring 13, mounted in a recess 8. The locking pin 7 is braced with its front tip 9 against the retaining pin 14, or strikes against a stop in the fixing block 6 at a slight distance from the retaining pin 14 in the rest position.

In recess 4, a release knob 18 is additionally provided, also rotatable around the axle 11, which is mounted in the axle hole 19. This release knob 18 has on the one hand a round sliding surface 25, which corresponds to the sliding surface 17. On the other hand, this release button 18 has two baffle openings 77 on the lateral flanks. The transverse pin 20, which is arranged in the locking pin through a transverse opening, is caught in these baffle openings.

If the release button is now pressed from above as shown in FIG. 1 (*e*), it deflects in a clockwise direction and thereby swivels the mounting block slightly counterclockwise through the contacting surfaces 25/17 on the one hand and on the other hand the locking pin is pushed into the interior of the mounting block 6 through the links 77 via the cross pin 20 against the spring force 13.

This opens the area 15, which is itself caught in the rest state by the front area 9 of the locking pin 7, and the loop 70, which was previously caught in the area 15, can be removed upwards from the slot through the area 71.

There are now two safety release mechanisms for such a grip head:

One safety release mechanism can be activated or comes into action if there is a strong upward pull on the loop, i.e. against the locking pin 7, for example by placing the loop in the concave area 10 on the lower surface of the locking pin. If a strong pull is now exerted in this direction, the fixing block 6 is swivelled upwards counter-clockwise around the axis 11 against the spring force of the coil spring 23, as shown in FIG. 1 (*e*), with the tip 9 exposing the area 15.

A second safety mechanism against lateral loads is provided by the fact that the entire mandrel block 26 can be swivelled as shown by the arrow 72 in FIG. 1*c*).

To ensure that this is done against a defined release force, there is, as shown in FIG. 1*f*) and *i*)-*p*), a front surface 36 of the mandrel block, which is in contact with a contact surface 37 on the handle head. A lower sliding surface 45 on the mandrel block 26 slides against a sliding surface 46 on the handle body. A step projecting into the handle body is now provided in the contact surface 37. At the zenith, this step has a locking groove 39, in which a corresponding projection 39*a* of the fixing block 6 engages in the middle position. In addition, the projection 39*a* can project into an axial recess 40. On the mandrel block 26 there are two projections 41 for engaging in the step of the surface 37. This step 37 is provided with two stop surfaces 44 each for a maximum rotational position of the mandrel block. On the one hand, the projections 41 each have an external stop surface 41*b*, which comes into contact with the respective stop surface 44 at the maximum rotational position of the mandrel block 26, and on the other hand, they have a sliding surface 41*a*, with which they slide along surface 38 during rotation. Furthermore, the projections 41 have an inclined stop surface 41*c* which, in the middle position, i.e. when the mandrel block 26 is not pivoted, comes into contact with the two flanks of the V-shaped extension 39*a* of the fixing block 6. The contouring of the contact surface 37 together with the corresponding surface structuring of the front surface 36 of the mandrel block 26 means that the mandrel block can only be deflected sideways along the arrow 72 after a trigger force has been exceeded. The force is determined by the fact that the contact surface 41*c*, when the rotary movement of the mandrel block 26 begins, must first swivel the fastening block 6 upwards as a result of the V-shaped extension area 39*a*, which is to a certain extent in the way. This upward pivoting movement of the fixing block 6 is determined by the spring force of the spring 23. The mandrel block can be deflected until the corresponding contour 41*b* on the mandrel block 26 comes into contact with the stop 44. This is typically an angular range of approx. 40-90°, measured to both sides. However, a deflection of up to 180° may also be possible.

Once such a deflection has taken place and no more force is applied, the mandrel block 26 is then returned to the vertical position due to the restoring force of the spring 23, which is transmitted to the mandrel block 26 via the range 39*a* and the corresponding flank 41*c*, and then, if necessary, engages again in this vertical position via corresponding contours.

If the mandrel block 26 or the entire handle head is loaded as intended by the loop 70 exerting a downward pull, the proposed design prevents the mandrel block 26 from inadvertently swinging sideways into the safety deflection.

FIG. 2 shows a second example. Parts that are equivalent or the same in themselves are marked according to the example in FIG. 1, and not all parts are therefore marked with reference numerals again for clarity.

In this case, the mandrel block 26 does not have a through-hole, but a recess or a blind hole 75. In this blind hole 75, a bracing pin 53, which runs essentially in the running direction 30, is pivotably mounted in the through-hole 61 in the mandrel block 26 via a cross pin or fastening pin 61.

This bracing pin 53 protrudes through a through-hole 56 into a cavity 58 in the handle head. In this cavity 58 a spiral spring 55 is provided, which circulates the tension pin 53. At the free end, an end nut is screwed onto the bracing pin 53 and secured against unscrewing by suitable means, whereby corresponding spring end elements are provided in between both on the side of the end nut 52 and on the stop on the back of the through-hole 56.

In this case, as can be seen in particular from FIGS. 2*f*) and *i*)-*p*), the front surface 36 of the mandrel blocks 26 and the corresponding contact surface 37 have a slightly different design than in the first design example. On the one hand, there are to a certain extent two lateral flanks 78 in the contact surface 37 on the body of the handle, so the contact surface 37 is implemented as a vertical channel in which the mandrel block engages with its surface 36. Likewise, there are two lateral bevelled flanks 78*a* in the front face 36 of the mandrel block 26, which lie in contact with the flanks 78 in the contact face 37 when the mandrel block 26 is not laterally deflected.

In addition, there is a spherical-calotte-shaped recess 59 below the through-opening 56 in the handle body in area 37 of the handle body, and a corresponding spherical-calotte-shaped bulge 60 is provided in area 36 of the mandrel block 26.

In the central middle position for the intended use, i.e. when the fixing mandrel 14 is directed vertically upwards, the calotte 60 of the mandrel block 26 engages in the recess 59 and, together with the lateral flanks 78 and 78*a* respectively, stabilises the fixing block 26 in the middle position by means of a positive fit.

If, in this example, a lateral pull is exerted on the holding mandrel 14, a force must be applied on the one hand by the form fit in contours 59 and 60. However, the entire mandrel block must also be pulled out of the grip head against the spring force of the spiral spring 55 slightly along the axis of the bracing pin 53, so that the mandrel block can slide over the flanks 78 or 78*a* in one or the other lateral direction and allow rotation. This ensures, in this case by means of the appropriate setting of the nut 52 or a corresponding end element 62, an adjustable release force for the lateral rotation in the sense of the above-mentioned second safety release.

In order to ensure the most stable construction possible and a safety release also at the top, it is possible to provide a bottom extension 79 with a through-hole in the mounting block.

This through-opening is also passed through by the bracing pin 53 and the end nut 52 is in the stop with the corresponding extension 79. This means that here the safety release is not implemented via an axial spring 23 for the fixing block when there is a pull upwards, but here, when a strong pull is exerted on a loop 70 upwards and a torque is correspondingly initiated/exerted via the locking pin, in the illustration according to FIG. 2*e* the fixing block 6 is turned away/released around the axis of rotation 11 in an anti-clockwise direction and against the compressive force of the spiral spring 55 analogous to the first safety solution mentioned above, while releasing the range 15.

The intended release of the loop 70 from the holding mandrel is again ensured by a release button 18 with corresponding links (grooves) 77, which is connected to the locking pin 7 via the transverse axis 20, which can be moved in the slotted hole 48.

A third example is shown in FIG. 3. Here at least the lower section 65 of the holding mandrel is made in one piece and from the same material as the handle body. The first safety release and the design of the mounting block 6, locking pin 7 including bracing pin 22 and spiral spring 23 is analogous to the design example 1 described above.

Here, however, an upper area 66 of the holding mandrel 14 is formed from a soft and elastically deformable/flexible plastic. There is a transition area 67 between the lower area 65 and the upper area 66.

Typically, such a grip head is produced in a two-component injection moulding process, using a different material for the 66 area than for the 65 area.

If in this case, a lateral load is now applied to the loop or a rotation is applied, the loop is moved slightly upwards on one side and then comes into the area of the upper soft and bendable area 66. As the upper area 66 is bendable, the hook can then also be made without a mechanical safety release with coil springs by rotating the fixing block 6 around the axis 11.

The transition area can be designed differently, different possibilities are shown in FIGS. 3*d-l*.

Thus, it is possible to provide a somewhat rounded cuboid axial extension 68 according to FIG. 3*g*. Alternatively, it is possible to provide a bridge-like extension made of hard material 68 as shown in FIG. 3*h*. The advantage of such a design is that the softer material can flow into the bridged area of the clamp 46 and thus ensure good adhesion between the hard area 65 and the upper area 66.

Another variant is shown in FIG. 3*i*, where extension area 68 is an essentially circular cylindrical trunnion.

In order to ensure a better connection between the upper area 66 and the lower area 65, as shown in FIG. 3*j*, a somewhat spherical extension can also be provided at the free end of extension 68.

Also for a better connection between the upper area 66 and the hard lower area 65 it is possible to provide a through opening in the extension 68, as shown in FIG. 3*k*.

Alternatively, as shown in FIG. 3*l*, or in addition, it is possible to provide 68 ribs or serrations on such an extension so that the soft material in the two-component injection moulding process not only flows around but also partially flows into this extension 68.

A further example is shown in FIG. 4. As a significant difference compared to the example shown in FIG. 1, it should be emphasized that here essentially the entire mechanism for the holding mandrel is combined in one unit, which can be assembled beforehand and then inserted into recess 4 in the stick handle 1 and fixed in this recess 4.

An essential element of this design is an additional retaining block 82, which is shown separately in two perspective views, especially in FIGS. 4*g*) and *h*). This retaining block 82 is intended as a support for the mandrel block 26. On a surface 87 of the retaining block 82 facing the mandrel block 26, a hollow circular cylinder extension 85 with an axial opening 86 is provided. The mandrel block 26 has a corresponding recess 28, which can be pushed onto the hollow cylinder extension 85. The mandrel block 26 can then be attached to the holding block 82 with a screw 88. Due to the design with the hollow cylindrical extension 85, the mandrel block 26 can then be rotatably mounted on the retaining block 82.

Furthermore, the retaining block 82 has two arms 84, at the ends of which two through openings 83 are provided. With a retaining pin 81, this retaining block 82 can be connected to the mounting block 6 and the release button 18. This is done by first pushing the release button 16 from above over the mounting block 6, into which the locking pin 7 with the spring 13 with the cross pin 20 can already be captured and inserted. Likewise, the holding block 82 with the two arms 84 is pushed on from below until the through openings 92, 83 and 98 are aligned and the holding pin 81 can be inserted. In doing so, the V-shaped extension 39*a* of the holding block 6 engages in a receiving pocket 94 in the mandrel block 26. The unit formed in this way from the elements 6, 18, 26 and 82 can be prefabricated and then inserted into the recess 4 in the stick handle 1 and fastened in this recess 4 via the fastening cross pin 99. After inserting the unit into the handle head and mounting the cross pin, the compression spring 23 with the two spring end caps is pushed from below through the handle bore onto the eye bolt 22 and fixed by means of the hexagon nut 24. In doing so, the compression spring 23 is pretensioned and thus the desired release force is also adjusted. The curved slot 91 in the release button 18 also fixes this unit in the recess 4, yet its elements can still move to the required mass for the release and locking functions.

With regard to the engagement of the loop-shaped device 70 behind the holding mandrel 14, this fourth example functions in essentially the same way as the first example: if the loop 70 is pushed over the holding mandrel 14 from above, the locking pin 7 moves into the fastening block 6 against the force of the coil spring 13, and after the loop 70 has reached the holding area 15, the locking pin 7 pushes against the holding mandrel 14 again and thus locks the loop 70 in the area 15.

Like the first example, the safety release also works in the same way when the loop 70 is pulled upwards: In this case, the force from below on the concave area 10 of the locking pin 7 swivels the fixing block 6 around the axis 81 against the force of the spring 23 (compare in particular FIG. 4*e*, there movement of block 6 counterclockwise), so that loop 70 is released.

The possible lateral safety deflection of the holding mandrel 14 against a controlled release force is ensured here by the engagement of the V-shaped extension 39*a* of the fixing block 6 in the receiving pocket 94 in the mandrel block 26. This receiving pocket 94 has two correspondingly V-shaped flanks 95, and if the mandrel block 26 is turned around the axis 88 by e.g. lateral pulling on the loop, this can only be done by the flanks 95 of the receiving pocket 94 in the mandrel block 26 sliding on the flanks of the extension 39*a* of the fastening block 6, thus deflecting the fastening block 6 upwards against the force of the spring 23.

This also allows the lateral deflection of the mandrel block 26 against this spring force and after loading, the mandrel block 26 jumps back into its original vertical starting position also because of this spring force.

A further example is shown in FIG. 5. It has a release mechanism similar to the example shown in FIG. 4, but additionally has a safety release around a second axis of rotation.

Specifically, the mandrel block 26 cannot be tilted downwards as intended when the hand strap is loaded, but can be tilted backwards slightly when the hand strap is loaded, so that the eye of the hand strap can slide out just between the locking pin and the retaining mandrel 14. In this way, a safety release around all three axes can be guaranteed to a certain extent.

In this example, an additional exchangeable cover is provided, which allows 111 accessories made of hard plastic, for example a protector for the hand (so-called gate guard, for example for slalom competition and training), to be attached to the pole handle using an adapter piece.

In perspective views in a) and b) the stick handle is shown with a closing cover 114 according to this design example, while in the perspective views in c) and d) this cover is replaced by an insert or adapter piece 111, typically made of metal, which has an internal thread 120 for a fastening screw, for example for a (not shown) hand guard. Typically, the hand guard is attached with its other free end at the bottom of the pole tube directly below the handle body.

The cover 114 can be seen better in the exploded view according to FIG. 5*e*. The cover inserted in figures a) and b) is cover 106. This cover 106 has a cover plate 114 which, when inserted, forms the surface of the upper part of the handle. This cover plate 114 is attached to the cane handle by means of a mounting stub 107 which engages in a corresponding blind hole or exposed area in the handle body and/or mounting block 7. At the lower end of this mounting stub 107 there is a transverse through-hole. The cover 106 can be fixed in the handle body with the cross pin 11 when inserted. Typically, a stick handle is sold with cover 160 inserted in this way. If a user now wishes to attach a hand protector to such a handle, for example, only the cross pin 11 needs to be removed, the cover 106 can be removed from the handle head, and the adapter piece 111 for the hand protector can now be inserted into the recess that is now released. This insert also has a mounting stub 107, at the lower end of which a transverse through-hole 113 is provided for the cross pin 11. The adapter piece 111 can thus be fixed in the handle head in the same way as the cover 106. However, the adapter piece 111 now has a collar or circumferential flange 112 at the top, and the fastening stub 107 is designed as a blind hole open at the top with an internal thread. The fastening screw of an accessory can now be screwed into this internal thread 120 without further ado, and the accessory is thus firmly fastened to the handle head without further manipulation.

In FIG. 5 *e*), particularly in a general view with g), it can now also be seen how in this example the retaining mandrel 14 is mounted around two rotary axes in the sense of a further improved safety release. The mandrel block 26 is in turn rotatably attached to a retaining block 82 by means of a screw 88. Here, too, the retaining block 82 has a hollow cylinder extension 85 provided for this purpose. The opening in this extension serves as a receiving opening for the screw 88 and is then also the axis of rotation for the mandrel block 26 about the first axis 86. Here, too, the retaining block 82 has two fork arms 84, at the free ends of which two aligned through-openings 83 are provided. Via these openings in 83, the retaining block 82 can be attached to the mounting block 6 with the retaining pin 81. For this purpose, the mounting block 6 has two lateral recesses and a through opening 92 in these. The two fork arms 84 of the retaining block 82 can be pushed into or onto these recesses until the through openings 83 are aligned with the through opening 92, then the cross pin 81 can be inserted. Here too, the eyebolt 22 is hinged to the mounting block 6 with the fixing pin 21.

In the mounting block 6, the locking pin 7 is also mounted in the recess 8 in this case so that it can be moved against the return of the spiral spring 13. The locking pin 7 is captured by the cross pin 20, which passes through the cross hole 64, protrudes beyond it on both sides, and engages in the guide slot 48 in the mounting block 6. Accordingly, the locking pin 7 can only be moved in the recess 8 within the limits defined by the oblong hole 48. The locking pin 7 braces the eye of the hand strap with its tip, for this purpose a concave area 10 is also provided here, which limits the area 15.

The unit thus formed, consisting of holding block 82, mandrel block 26 and fixing block 6, is held in the recess 4 in the handle head by the bracing pin (eyebolt) 22 fixed by the fixing pin 21, which is braced from below via cavity 5 with the spiral spring 23 and fixed with the end nut 24.

On the other side, the release button 18 on this unit is also caught by the cross pin 21. The cross pin protrudes with its two free ends beyond the lateral surface of the mounting block 6 and engages in the two curved oblong holes 101 of the release button 18. The release knob 18 has a transverse through-hole 100, and is mounted in the handle head so that it can be tilted around the axis of this transverse pin 11 via the transverse pin 11, which passes through the through-hole 109 in the handle body. If the release button 18 is pressed down in the rear area, i.e. at the holding mandrel 14, the cross pin 21 is displaced in the running direction due to the slotted link 101 and thus the locking pin 7 is pushed further into the recess 8 against the force of the spring 13, thus releasing the area 15. This is the manipulation that is carried out when the user wants to release the hand strap from the grip body as intended.

As far as the release around the first axis of rotation is concerned, this functions in the example shown in FIG. 5 in the same way as in the example in FIG. 4.the mandrel block is mounted so that it can rotate around axis 88 on the retaining block 82, whereby here too a V-shaped extension 39*a* on the retaining block 82 engages in a receiving pocket 94 in the mandrel block 26. When the mandrel block is rotated about the first axis of rotation, the extension 39*a* moves along the inclined flanks 95 and moves the mounting block 6 upwards against the return of the spring 23.

In addition, this design example now includes a release around the second rotation axis 121 perpendicular to the direction of travel and perpendicular to the stick axis. This slight tilting possibility as a safety release is realized by the saddle 119, on which the unit consisting of holding block 82 and mandrel block 26 is placed. On the one hand, with a downward extension 103 of the holding block 82, and on the other hand with the contact area 105, which is formed by the lower part of the front surface 36 of the mandrel block 26. Pulling on the retaining mandrel 14 in the illustration in FIG. 5 *g*) now causes the unit formed by retaining block 82 and mandrel block 26 to tilt clockwise to the right about the second axis 121. At the same time, the fixing block 6 moves around the axis 81 slightly counter-clockwise, so that the area 15 is opened slightly, and the fixing block 6 moves slightly to the right. This is possible because the cross pin 11 can be moved in an elongated recess 110 of the mounting block 6, which is open at the top. During this displacement, the release button 18 remains in its normal position. This now causes the cross pin 21 to move upwards in the curved slot 101, thus pushing the cross pin to the left and the locking pin 7 into the fixing block 6. In other words, the fastening pin 7 does not follow the displacement of the fastening block 6 to the right as shown in FIG. 5 *g*) and thus the eyelet is released from the area 15. Another feature that distinguishes the example in FIG. 5 from that in FIG. 4 is the cover 102, which has two opposite transparent or even through-opening areas 115 on either side of the handle body, through which the coil spring 23 is visible. The cover 102, which may be made of transparent or translucent material, for example, and may be decorated in whole or in part, can now be snapped onto the handle body from behind, covering the areas 115. In this design example the cover 102 is to a certain extent in the shape of a saddle, but it is also possible to provide two such covers for each side individually. Furthermore, it is possible to replace the aforementioned transparent or semi-transparent covers with covers that are provided with a non-slip surface to increase the non-slip surface of the handle and thus create more grip. The non-slip surface can be created, for example, by a sprayed-on skin of a softer plastic material or by a structured, roughened surface.

LIST OF REFERENCE SIGNS

| | |
|---|---|
| 1 | pole handle |
| 2 | cane pipe |
| 3 | handle body |
| 4 | recess in 3 |
| 5 | cavity in 3 for stick pipe |
| 6 | mounting block |
| 7 | locking pin |
| 8 | recess in 6 for 7 |
| 9 | front area of 7 |
| 10 | concave area at tip of 7 |
| 11 | rotation axis of 18, cross pin |
| 12 | rear area of 7 |
| 13 | spiral spring |
| 14 | holding mandrel |
| 15 | area for attached loop/eyelet |
| 16 | recess in 3 for 14 |
| 17 | round sliding surface at 6 |
| 18 | release button |
| 19 | axle hole for 11 |
| 20 | cross pin of 7 |
| 21 | fixing pin |
| 22 | tension pin, eye bolt |
| 23 | spiral spring |
| 24 | trap nut |
| 25 | round sliding surface at 18 |
| 26 | mandrel block |
| 27 | fixing pin from 26 |
| 28 | through opening in 26 for 27 |
| 29 | pole axis |
| 30 | walking direction |
| 31 | head area of 1 |
| 32 | front extension of 1 in the head area |

-continued

| LIST OF REFERENCE SIGNS | |
|---|---|
| 33 | fastening element for 27, detent and turning extension at 26 |
| 34 | opening in handle body for 26/27 |
| 35 | cylinder extension range from 33 |
| 36 | front area of 26 |
| 37 | contact surface on handle body |
| 38 | sliding surface for contour at 26 on handle body |
| 39 | groove in 38 |
| 39 | V-shaped extension at 6 |
| 40 | axial recess |
| 41 | projection on 26 |
| 41a | siding surface of 41 to 38 |
| 41b | stop surface of 41 to 44 |
| 41c | stop surface of 41 to 39a |
| 42 | extendedarea, snap-in range of 33 |
| 43 | cylinder area of 33 |
| 43a | slots in 33 |
| 44 | abutment surface |
| 45 | lower sliding surface at 26 |
| 46 | sliding surface on handle body corresponding to 45 |
| 47 | fastening eyelet of 22 |
| 48 | guide slot |
| 49 | opening in 18 for 11 |
| 50 | opening from 4 to 51 |
| 51 | axial location hole for axial spring from mounting block |
| 52 | trap nut |
| 53 | eyebolt, tension pin of 26 |
| 5 | fastening eyelet of 53 |
| 55 | coil spring |
| 56 | opening for 53 in stick handle |
| 57 | spring end element |
| 58 | cavity for 53/55 |
| 59 | concave-calotte-shaped recess in the handle body |
| 60 | dome shaped projection at 26 |
| 61 | fixing pin for 53 to 26 |
| 61a | cross hole for 61 in 26 |
| 62 | completion element |
| 63 | washer |
| 64 | cross hole in 7 for 20 |
| 65 | lower mandrel area |
| 66 | upper mandrel area |
| 67 | contact range between 65 and 66 |
| 68 | expansion of 65 |
| 69 | hand holding device |
| 70 | loop, ring or eyelet shaped device |
| 71 | insertion slot |
| 72 | lateral deflection |
| 73 | rotary axis |
| 74 | lower range of 26 |
| 75 | back hole in 26 |
| 77 | guide slot for 20 in 18 |
| 78 | sided flanks/raises of 37 |
| 78a | side edges from 36 at 26 to the system at 78 |
| 79 | bottom side extension of 6 |
| 80 | opening in 79 for 53 |
| 81 | holding pin |
| 82 | holding block |
| 83 | opening in 84 |
| 84 | fork arm of 82 |
| 85 | hollow circle cylinder extension |
| 86 | axis opening in 85 |
| 87 | front area of 82 |
| 88 | screw |
| 89 | passage for pin 22 |

-continued

| LIST OF REFERENCE SIGNS | |
|---|---|
| 90 | opening for 87 |
| 91 | slot for 87 |
| 92 | opening in 6 for 81 |
| 93 | opening for 21 |
| 94 | receptacle for 39a |
| 95 | sloping flanks of 94 |
| 96 | front boundary wall of 94 |
| 97 | expansion in 28 for head of 88 |
| 98 | opening for 81 of 16 |
| 99F | fixing cross pin |
| 100 | through opening for 11 through 18 |
| 101 | curved oblong hole in 18 for 21 |
| 102 | cover |
| 103 | continuation on 82 |
| 104 | abutment surface for 105 |
| 105 | abutment area of 26 |
| 106 | cover |
| 107 | fixing butt |
| 108 | opening in 107 for 11 |
| 109 | opening in 3 for 11 |
| 110 | long recess in 6 for 11 |
| 111 | adapter piece |
| 112 | circumferential flange of 111 |
| 113 | opening in 111 for 11 |
| 114 | cover plate of 106 |
| 115 | viewing opening or viewing window in 3 |
| 116 | abutment for 103 |
| 117 | upper attachment point of 6 |
| 118 | slide gate on underside of 18 for 117 |
| 119 | saddle |
| 120 | female threaded hole in 111 |
| 121 | Second axis of rotation |

The invention claimed is:

1. A pole handle comprising a handle body and with a hook-like device for fastening a hand holding device, wherein in the region of the hook-like device displaceable latching means are arranged in such a way that a loop-shaped, ring-like or eyelet-like device which is pushed onto the hook-like device substantially from above and is provided on the hand holding device, is fixed on the hook-like device in a self-latching manner, wherein the hook-like device on the stick handle is arranged on the hand side in the upper region, wherein the hook-like device comprises a holding mandrel or holding pin, which is set off from the handle body to the hand side, forming an upwardly open insertion slot, or is arranged as an incision in the handle body, and wherein the latching means are in the form of a retaining lug which, in the clamped position, defines a region for the loop, ring or eyelet shaped device which is restricted against a force, and wherein an upper region of the holding mandrel or holding pin or the entire holding mandrel or holding pin, viewed in the walking direction, can be deflected laterally to both sides against a restoring force.

2. The pole handle according to claim 1, wherein the holding mandrel is attached to a mandrel block or is formed thereon, and the mandrel block is directly or indirectly mounted on the handle body so as to be rotatable about an axis of rotation against a force or restoring force.

3. The pole handle according to claim 2, wherein the mandrel block comprises an upper portion formed by the holding mandrel and a lower portion, the lower portion having a front surface in contact with a contact surface on the handle body or on a holding block, an axis passing through these surfaces is provided.

4. The pole handle according to claim 2, wherein a horizontal first passage opening is provided in the handle body or in the holding block in the walking direction and a coaxial second passage opening is provided in the mandrel block, and a fastening pin or a screw is arranged as an axis of rotation passing at least partially through the first and second passage openings.

5. The pole handle according to claim 4, wherein the fastening pin is fastened in the mandrel block, and a free end of the fastening pin facing the handle body and projecting beyond the mandrel block passes through the first through opening and is locked against axial displacement in an extension region located behind it by means of a fastening element.

6. The pole handle according to claim 4, wherein the fastening pin is fastened in the mandrel block, pressed in, glued in, screwed in or a combination thereof, and a free end of the fastening pin facing the handle body and projecting beyond the mandrel block passes through the first through opening and is locked against axial displacement in an extension region located behind it by means of a fastening element, wherein the fastening element has an at least partially hollow-cylindrical region arranged in the first passage opening as well as a radially widened region lying therebehind with a larger diameter than the diameter of the first passage opening, and wherein the fastening element is designed to be self-fixing when the fastening pin is inserted and/or has axial slots.

7. The pole handle according to claim 2, wherein a horizontal first through-opening is provided in the handle body in the walking direction and a coaxial blind hole opening is provided in the mandrel block, and a bracing pin is arranged as an axis of rotation passing at least partially through the first and second opening, and wherein the bracing pin can be moved out of the handle body against a spring force.

8. The pole handle according to claim 7, wherein the locking contours are provided in the form of depressions and corresponding elevations in the contact surfaces in contact in the basic position.

9. The pole handle according to claim 7, wherein the bracing pin is fastened in the blind hole opening by means of a fastening eyelet and a fastening pin.

10. The pole handle according to claim 7, wherein the locking contours are provided in the form of depressions and corresponding elevations in the contact surfaces in contact in the basic position, in the form of at least one dome-shaped elevation and corresponding dome-shaped depression, wherein these locking contours are arranged vertically below or above the bracing pin.

11. The pole handle according to claim 7, wherein the bracing pin is fastened in the blind hole opening by means of a fastening eyelet and a fastening pin, is embraced at least in sections at the region projecting into the handle body by a spiral spring loaded by a pressure, the spiral spring resting on an extension arranged behind the first passage opening, and is limited at the free end by a closing element, wherein a fastening block, in which the locking pin is displaceably mounted, is arranged in a recess of the handle body, and the bracing pin passes through a through-opening in a lower extension of the fastening block.

12. The pole handle according to claim 2, wherein lower portion of the holding mandrel on the handle body is formed of a substantially non-flexible material, and an upper portion or at least a transition portion between the lower portion and an upper portion is formed of a flexible material, so that the upper region can be deflected relative to the lower region against a restoring force.

13. The pole handle according to claim 2, wherein the mandrel block comprises an upper portion formed by the holding mandrel and a lower portion, the lower portion having a front surface in contact with a contact surface on the handle body or on a holding block, an axis passing through these surfaces is provided, and these surfaces slide against each other during lateral deflection of the mandrel block, the axial length of the lower region being at least as great as the axial length of the upper region formed by the holding mandrel.

14. The pole handle according to claim 13, wherein the axial length of the lower region is 1-2 times as great as the axial length of the upper region formed by the holding mandrel.

15. The pole handle according to claim 2, wherein a horizontal first passage opening is provided in the handle body or in the holding block in the walking direction and a coaxial second passage opening is provided in the mandrel block, and a fastening pin or a screw is arranged as an axis of rotation passing at least partially through the first and second passage openings, and wherein a contact surface on the handle body or on the holding block and a front contact surface on the mandrel block have corresponding locking contour, which by means of positive locking provide a basic position in which the holding mandrel is arranged vertically and which allows lateral deflection only after a release force has been reached, wherein in addition a lateral maximum stop is provided for rotation, or wherein in a recess of the handle body above the holding block a fixing block is arranged in which a locking pin is displaceably mounted, and which fixing block is mounted in the recess so as to be partially rotatable or pivotable against the force of a spring, wherein the mandrel block is rotatably mounted on the holding block, and wherein the fixing block has, in the region facing the mandrel block, a downwardly directed extension which engages into a recess in the mandrel block, so that when the mandrel block is deflected laterally, the extension is displaced upwards and the fastening block is tilted against the force of the spring in the recess.

16. The pole handle according to claim 15, wherein mandrel block, retaining block, fastening block and a release button are also arranged at least partially in the recess, arranged at the upper head end of the handle, and are designed as a connected unit which can be prefabricated and inserted as a whole into the recess and fastened therein.

17. The pole handle according to claim 2, wherein a horizontal first through-opening is provided in the handle body in the walking direction and a coaxial blind hole opening is provided in the mandrel block, and a bracing pin is arranged as an axis of rotation passing at least partially through the first and second opening, and wherein the bracing pin can be moved out of the handle body against a spring force, and a contact surface on the handle body and a front contact surface on the mandrel block have corresponding detent contours which by means of positive locking specify a basic position in which the holding mandrel is arranged vertically, and which do not permit lateral deflection until a release force is reached.

18. The pole handle according to claim 2, wherein lower portion of the holding mandrel on the handle body is formed of a substantially non-flexible material, and an upper portion or at least a transition portion between the lower portion and an upper portion is formed of a flexible material, so that the upper region can be deflected relative to the lower region against a restoring force, and wherein the lower region ends up vertically above the lowest point of the region for the attached loop/eyelet.

19. The pole handle according to claim 18, wherein in the transition region between the lower region and the upper region the material of the lower region extends at least partially into the upper region in the form of an enlargement extending along the direction in which the holding mandrel extends, and the material of the upper region or the transition region surrounds this extension at least partially or completely surrounding this extension, and wherein the extension comprises a cylindrical, parallelepipedic, with or without rounded edges, with or without additional extension at the free end, with or without serrations.

20. The pole handle according to claim 2, wherein lower portion of the holding mandrel on the handle body is formed of a substantially non-flexible material, and an upper portion or at least a transition portion between the lower portion and an upper portion is formed of a flexible material, so that the upper region can be deflected relative to the lower region against a restoring force, wherein the lower region ends up vertically 1-3 mm above the lowest point of the region for the attached loop/eyelet.

21. The pole handle according to claim 1, wherein the holding mandrel is attached to a mandrel block or is formed thereon, and the mandrel block is directly or indirectly mounted on the handle body so as to be rotatable about a first axis of rotation against a restoring force, wherein the first axis of rotation is oriented substantially perpendicular to the stick axis and substantially in the walking direction, and wherein the mandrel block is oriented about a second axis of rotation substantially perpendicular to the stick axis and substantially perpendicular to the running direction, can be tilted by an angle of at most 30°.

22. The pole handle according to claim 1, wherein in a recess of the handle body, a separate fastening block with locking pin and guidance of the locking pin is fastened.

23. The pole handle according to claim 1, wherein the hook-like device comprises a holding mandrel or holding pin arranged substantially parallel to the stick axis, which is set off from the handle body to the hand side, forming an insertion slot, or is arranged as an incision in the handle body or wherein the hook-like device has a width in the range of 3-15 mm, the hook-like device having an essentially oval or lenticular cross-section, the short main axis being directed towards the handle body or that the insertion slot has a depth in the range of 5-30 mm.

24. The pole handle according to claim 1, wherein the retaining lug is designed in the form of a locking pin which is displaceably mounted in the handle head or in a fastening block mounted in the handle head and is oriented in the walking direction, and wherein the front region of the locking pin has a concave recess, on the underside facing the region for the attached loop or eyelet.

25. The pole handle according to claim 1, wherein the pole handle has a lower handle body region which forms a lower wrap-around region of the pole handle and has a recess for a pole tube at the lower end, and a head region, wherein the head region has a front extension which in the front pole grip region merges substantially without a step into the upper embracing region, wherein the extension in the front pole grip region is formed with a projection in the direction of travel projecting beyond the embracing region, wherein the projection is more than 50% of an average extension of the gripping area in the direction of travel, and a sectional plane of the head region, which is defined by a transverse axis of the head region arranged transversely to the longitudinal axis of the pole and transversely to the direction of travel, where the head region is widest measured transversely to the running direction and transversely to the longitudinal axis of the pole, and a foremost tip of the widening is stretched out, is angled at an obtuse angle of in the range of 90-135 degrees from the longitudinal axis of the pole.

26. A pole with a pole handle according to claim 1.

27. The pole according to claim 26 in the form of a walking stick, trekking stick, alpine ski stick, cross-country skiing stick, or Nordic walking stick.

28. The pole according to claim 26 in the form of a one-piece or, according to the requirements, adjustable multi-part stick tube and a stick tip, alone or in combination with a hand holding device in the form of a hand loop or glove, with a loop, ring or eyelet shaped device which is provided on the hand holding device.

29. The pole handle according to claim 1, wherein said handle is for walking sticks, trekking sticks, alpine ski poles, cross-country ski poles, Nordic walking sticks.

30. The pole handle according to claim 1, wherein the hand holding device is in the form of a hand loop or a glove.

31. The pole handle according to claim 1, wherein the holding mandrel is attached to a mandrel block or is formed thereon, and the mandrel block is directly or indirectly mounted on the handle body so as to be rotatable about an axis of rotation against a force or restoring force, wherein the axis of rotation is aligned substantially perpendicular to the stick axis and substantially in the walking direction, and wherein the axis of rotation is arranged below the area for the loop-shaped, ring-shaped or eyelet-shaped device.

32. The pole handle according to claim 31, wherein the axis of rotation is arranged 2-25 mm below the area for the loop-shaped, ring-shaped or eyelet-shaped device.

33. The pole handle according to claim 31, wherein the axis of rotation is arranged 5-12 mm below the area for the loop-shaped, ring-shaped or eyelet-shaped device.

34. The pole handle according to claim 1, wherein the holding mandrel is attached to a mandrel block or is formed thereon, and the mandrel block is directly or indirectly mounted on the handle body so as to be rotatable about a first axis of rotation against a restoring force, wherein the first axis of rotation is oriented substantially perpendicular to the stick axis and substantially in the walking direction, wherein the mandrel block is oriented about a second axis of rotation substantially perpendicular to the stick axis and substantially perpendicular to the running direction, can be tilted by an angle of at most 15° or of at most 10° or 5°, wherein the second axis of rotation is arranged below the first axis of rotation, wherein during the tilting movement about the second axis of rotation the restricted area for the loop-shaped, ring-shaped or eyelet-shaped device is released, and wherein this is at least partially effected by a displacement of the fastening block caused by the tilting movement when the locking pin is retained.

35. The pole handle according to claim 1, wherein in a recess of the handle body, which recess is designed as a recess running in the walking direction so that the head area is formed laterally by the handle body, a separate fastening block with locking pin and guidance of the locking pin is fastened, rotatable or pivotable about an axis, and/or a release knob is provided, at the upper head end and to be actuated from above, with which either the fastening block as a whole can be tilted to release the loop or the locking pin can be pushed back into the interior of the fastening block to release the loop via a corresponding slotted link on the release knob and a transverse pin guided through the locking pin.

36. The pole handle according to claim 1, wherein the hook-like device comprises a holding mandrel or holding pin arranged substantially parallel to the stick axis, which is set off from the handle body to the hand side, forming an insertion slot, or is arranged as an incision in the handle body, the depth of the insertion slot being greater than the width and the thickness of the holding mandrel or holding pin, or wherein the hook-like device has a width in the range of 4-8 mm, the hook-like device having, at least in sections perpendicular to the stick axis, an essentially oval or lenticular cross-section, the short main axis being directed towards the handle body, or wherein the insertion slot has a depth in the range of 10-15 mm.

37. The pole handle according to claim 1, wherein the retaining lug is designed in the form of a locking pin which is displaceably mounted in the handle head or in a fastening block mounted in the handle head and is oriented in the walking direction, which is horizontally oriented or sloping in the walking direction, and wherein the front region of the locking pin has a concave recess, in the form of a groove extending horizontally and transversely to the walking direction, on the underside facing the region for the attached loop or eyelet.

38. The pole handle according to claim 1, wherein the pole handle has a lower handle body region which forms a lower wrap-around region of the pole handle and has a recess for a pole tube at the lower end, and a head region, wherein the head region has a front extension which in the front pole grip region merges substantially without a step into the upper embracing region, wherein the extension in the front pole grip region is formed with a projection in the direction of travel projecting beyond the embracing region, wherein the projection is more than 50% of an average extension of the gripping area in the direction of travel, and a sectional plane of the head region, which is defined by a transverse axis of the head region arranged transversely to the longitudinal axis of the pole and transversely to the direction of travel, where the head region is widest measured transversely to the running direction and transversely to the longitudinal axis of the pole, and a foremost tip of the widening is stretched out, is angled at an obtuse angle of in the range of 90-135 degrees from the longitudinal axis of the pole, and wherein the head region in this cutting plane has a rounded contour, the front portion of which facing the direction of travel is substantially defined by an arc of a first circle and the rear portion of which, opposite the direction of travel, is substantially defined by an arc of a second circle, the centres of which along the direction of travel are offset by 0.5-6 cm offset from one another, the radius of curvature of the first circle being smaller than the radius of curvature of the second circle in the rear stick grip area.

* * * * *